US006590544B1

(12) United States Patent
Filipovic

(10) Patent No.: US 6,590,544 B1
(45) **Date of Patent: *Jul. 8, 2003**

(54) DIELECTRIC LENS ASSEMBLY FOR A FEED ANTENNA

(75) Inventor: Daniel Filipovic, San Diego, CA (US)

(73) Assignee: Qualcomm, Inc., San Diego, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/146,457

(22) Filed: Sep. 1, 1998

(51) Int. Cl.[7] ..... H01Q 19/06

(52) U.S. Cl. ..... 343/753; 343/700 MS; 343/911 R

(58) Field of Search ..... 343/700 MS, 753, 343/754, 911 R, 780

(56) References Cited

U.S. PATENT DOCUMENTS 4,755,820 A * 7/1988 Backhouse et al. .. 343/700 MS
4,876,554 A * 10/1989 Tubbs ..... 343/780
5,706,017 A * 1/1998 Buttgenbach ..... 343/753

FOREIGN PATENT DOCUMENTS

DE 27 38 549 A1 * 3/1979 ..... H01Q/19/06

* cited by examiner

*Primary Examiner*—Don Wong
*Assistant Examiner*—Shih-Chao Chen
(74) *Attorney, Agent, or Firm*—Philip R. Wadsworth; Gregory D. Ogrod; Thomas M. Thibault

(57) ABSTRACT

A novel and improved dielectric lens assembly (100) includes a dielectric extension (108) on a hemispherical dielectric lens (104), to provide a dielectric lens which exhibits properties of an elliptical lens. The extended dielectric lens can be implemented with a feed antenna (112) to improve the directivity of the antenna. The extension portion (108) of the lens assembly (100) is fabricated using a plurality of dielectric wafers disposed on the bottom surface of the hemisphere, an angled extension (516), or a cylindrical extension. The entire hemispherical lens and extension assembly (508) can be a single piece of dielectric material formed into the desired shape, or the assembly can be fabricated using a plurality of dielectric components (512, 516) coupled together to form the lens assembly.

25 Claims, 17 Drawing Sheets

SIDE VIEW

TOP VIEW

DIELECTRIC LENS ASSEMBLY FOR A FEED ANTENNA

BACKGROUND OF THE INVENTION

I. Field of the Invention

The present invention relates to antenna technology. More particularly, the present invention relates to a novel and improved dielectric lens antenna.

II. Description of the Related Art

Wireless communication systems are playing an increasingly important role in contemporary society. An integral and important component of any wireless communication system is the antenna. Antennas in a wireless communication system provide a region of transition between a guided wave and a free space wave. Antennas are used as both a transmitting device and a receiving device.

In order to increase the performance of the communication systems, antennas are designed to radiate (or receive) energy as effectively as possible. One measure of the effectiveness of the antenna is its gain. One way to increase the gain of an antenna is to increase the antenna's directivity. However, with directional antennas, the increase in gain is in a preferred direction and is typically obtained at the expense of gain in other directions. Thus, while directional antennas provide increased gain in the preferred direction, unless the antenna is pointed at the target (or source) with a fair degree of accuracy, the antenna is not being utilized effectively.

To take advantage of an antenna's directivity, systems which utilize directional antennas typically also include a mechanism for pointing the antenna such that the antenna's main lobe is pointed at the target (or source). In systems where the relative positions of the source and target change over time, a mechanism for steering the directional antenna is often utilized.

For example, a satellite ground terminal or earth station typically utilizes highly directional dish antennas to communicate with one or more orbiting satellites. High directivity and high gains are achieved by utilizing dishes having diameters anywhere from several centimeters in diameter to several hundred meters in diameter. Because such antennas are highly directional, they must be pointed at the satellite with a great amount of accuracy.

To achieve this pointing accuracy, expensive and complex antenna mounts are utilized. These mounts are typically one of two types: x-y mounts and azimuth-elevation (az-el) mounts. Both types of mount require a pointing algorithm to determine the desired direction for the antenna and a motor and motor control system to steer the antenna to the desired position. Such antenna mounts and their associated motor and motor control systems are mechanical in nature and utilize moving parts. As such, regular maintenance and upkeep of such systems is required, and the systems are subject to failure.

The use of steerable antenna mounts is not limited to dish antennas at satellite earth stations. Indeed, there are numerous other applications where it is desirable to steer an antenna (dish or otherwise) to a target (source). In most conventional applications, as with the satellite-dish application described above, the antenna pointing/steering systems are mechanical in nature and utilize moving parts. As such, these systems are also subject to the same maintenance and upkeep concerns as the satellite-dish systems. In addition, their relative speed in changing directions using mechanical drivers may be slower than desired for some applications.

Another technique used to increase the gain of an antenna is to focus the energy using a dielectric lens. Dielectric lenses are typically fabricated by shaping a dielectric material having an index of refraction $\eta_0$, where $\eta_0$ is greater than one. Dielectric lenses have been used in communication and radar systems to focus electromagnetic waves and to adjust the aperture of an antenna. The operation of a dielectric lens with electromagnetic waves at radio and microwave frequencies is analogous to the operation of optical lenses in an optical system. One common use of a dielectric lens is to convert a signal having a spherical phase front to one having a planar phase front, thus, focusing the radiation into a narrow beam.

SUMMARY OF THE INVENTION

The present invention is a novel and improved dielectric lens assembly. According to the invention, an extension of length L is included on a hemispherical dielectric lens to provide a dielectric lens which exhibits properties of an elliptical lens. The extended dielectric lens can be implemented with a feed antenna, such as, for example, a slotline antenna or a spiral antenna, to improve the directivity of the antenna.

In one embodiment, the extension portion of the lens assembly is fabricated using a plurality of dielectric substrates or plates. The substrates are disposed on the bottom surface of the hemisphere to allow the feed antenna to be positioned at a distance L from the center of the sphere described by the hemispherical dielectric. Preferably, the position of the feed antenna on the extension is coincident with the focus of an ellipse synthesized by the combination of the hemispherical lens and extension.

The extension can be made of the same dielectric material as the lens, or of alternative dielectric materials. Where alternative dielectric materials are used, it may be desirable to use a matching layer at the hemisphere/extension interface.

The entire hemispherical lens and extension assembly can be a single piece of dielectric material formed into the desired shape, or the assembly can be fabricated using a plurality of dielectric components coupled together to form the lens assembly.

In one embodiment, the extension is roughly cylindrical in shape. In alternative embodiments, the extension is of an alternative shape suitable for positioning the feed antenna at the focus of the synthesized ellipse.

In yet additional alternative embodiments, the extension portion of the lens assembly is angled to allow the feed antenna to be positioned off axis, while maintaining a roughly constant extension length L. With the angled extension embodiment, one or more planar surfaces are provided on the extension.. The distance from a point on the planar surface through the center of the sphere described by the hemisphere to the aperture surface of the hemispherical lens is within a range of lengths for which the directivity of the signal is above a threshold level, from any point along the surface.

In yet another alternative embodiment, the extension portion of the lens assembly is hemispherical and preferably has a radius equal to an optimum extension length L. Because the radius is equal to the optimum extension length L, the feed antenna can be positioned anywhere on the surface of the extension while maintaining optimum directivity. As such, antenna pointing by positioning or selecting an antenna at a point on the surface can be accomplished while maintaining optimum directivity.

In one embodiment, the dielectric lens assembly is implemented in conjunction with an objective lens to enable coupling of the antenna with another system.

Although this document utilizes the word "planar" to describe the one or more surfaces of the angled extension, it is not intended to limit the configuration of the surface to that of a perfectly planar surface. As would be understood by one of ordinary skill in the art after reading this description, the planar surface need only be "perfect" enough to provide a suitable mounting surface for the planar antenna used in the preferred embodiment. Thus, the planar surface can be merely approximately planar. Additionally, as understood by one of ordinary skill in the antenna art, a "planar antenna" is also not necessarily perfectly planar.

BRIEF DESCRIPTION OF THE DRAWINGS

The features, objects, and advantages of the present invention will become more apparent from the detailed description set forth below when taken in conjunction with the drawings in which like reference numbers indicate identical or functionally similar elements. Additionally, the left-most digit of a reference number identifies the drawing in which the reference number first appears.

DETAILED DESCRIPTION OF THE PREFERRED EMBODIMENTS

Overview of the Invention

The present invention is directed toward a dielectric lens having an extended hemispherical configuration. The dielectric lens according to the invention can be described as having two portions, a hemispherical portion and an extension portion. Varying the length of the extension portion allows the radiation patterns of signals to be adjusted.

Figure 1:
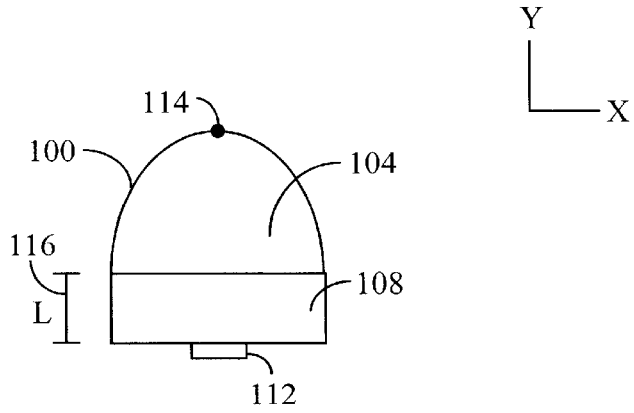
FIG. 1 is a diagram illustrating an extended hemispherical dielectric lens according to one embodiment of the invention.

FIG. 1 is a diagram illustrating an extended hemispherical dielectric lens 100 according to one embodiment of the invention. Referring now to FIG. 1, extended hemispherical dielectric lens 100 in this embodiment includes a hemispherical portion 104 and an extension portion 108. Hemispherical portion 104 and extension portion 108 are fabricated using a dielectric material having a dielectric constant greater than that of the communication medium. For example, for use in air, the dielectric constant of the dielectric material would need to be greater than 1.

A feed antenna 112 is mounted on, or mounted in close proximity with, extended hemispherical dielectric lens 100. Feed antenna 112 is used to radiate or receive energy. Extended hemispherical dielectric lens 100 focuses the energy as described herein.

In this document, the radiation patterns of extended hemispherical dielectric lens 100 ("dielectric lens 100") are described using ray-tracing inside lens 100 and electric and magnetic field integration on the surface of hemispherical portion 104 of dielectric lens 100.

In one embodiment described in more detail below, extension portion 108 is fabricated using a plurality of planar silicon substrates combined in a layered fashion to achieve a desired extension length 116 (shown as "L" in FIG. 1).

As discussed above, dielectric lens 100 according to the invention can be fabricated using any of a number of different dielectric materials. In this section of the document, two dielectric lenses 100 having different dielectric constants, silicon ($\epsilon_r$=11.7) and fused quartz ($\epsilon_r$=3.8), are analyzed. After reading this description, it will become apparent to one of ordinary skill in the art how the invention can be implemented with alternative materials having different dielectric constants.

Although other antennas for feed antenna 112 can be chosen, the planar feed antenna 112 chosen to describe the embodiments herein is a double-slot antenna. If the dimensions are chosen properly, the double-slot antenna launches a nearly perfect fundamental Gaussian-beam into dielectric lens 100. Therefore, a simple way to measure the aberrations introduced by dielectric lens 100 is to measure the pattern-to-pattern coupling value of the far-field patterns of dielectric lens 100 to a fundamental Gaussian-beam. The total power coupling into the antenna, termed the Gaussian-coupling efficiency, is a function of this coupling value and all the losses (reflection loss, dielectric backside loss, etc.).

The double-slot antenna design was chosen for this description because it is experimentally realizable. Therefore, this document discloses both theoretical and experimental results. Because the properties of the main beam are primarily determined by dielectric lens 100, and only to a lesser extent by feed antenna 112, the embodiments disclosed herein can be implemented using other types of antennas including slot-ring, double-dipole, log-periodic, spiral feed antennas, and other similar or known antennas.

Synthesis of an Elliptical Lens

A desirable dielectric lens has an elliptical shape. An elliptical lens can be synthesized from extended hemispherical lens 100 by carefully choosing extension length 116. Because the geometry of dielectric lens 100 is rotationally symmetric in the preferred embodiment, this analysis is adequately described in two dimensions.

The defining equation for an ellipse is:

$$\left(\frac{x}{a}\right)^2+\left(\frac{y}{b}\right)^2=1 \tag{1}$$

The ellipse has foci at ±c, where $c=\sqrt{b^2-a^2}$. According to optics theory, for a given index of refraction n, the eccentricity of the ellipse can be defined such that the geometric focus becomes the optical focus. Such eccentricity is given by:

$$eccentricity=\frac{\sqrt{b^2-a^2}}{b}=\frac{1}{n} \tag{2}$$

From this one can derive that:

$$b=\frac{a}{\sqrt{1-\frac{1}{n^2}}} \tag{3}$$

$$c=\frac{b}{n} \tag{4}$$

A hemisphere of unit radius is defined by $x^2+y^2=1$, for $y\geqq 0$. The distance from a circular tip 114 of hemispherical portion 104 (i.e., (x,y)=(0,1)) to the end of extension portion 108 is equal to 1+L, where L is extension length 116. The distance from the tip of an ellipse to its more distant focus is equal to b+c. These distances must be equal in order to superimpose the two lenses (i.e., 1+L=b+c). This yields the following expression: L=b+c−1. In order for the focus of the ellipse to have the same coordinates as the focus of the extended hemisphere, the ellipse must be shifted down by a value of $y_0$=L−c. Thus, given the index of refraction, the parameter b is varied until the extended hemisphere appears to have the closest geometrical match to an ellipse (b will be positioned within a narrow range no matter how this is defined).

Figure 2:
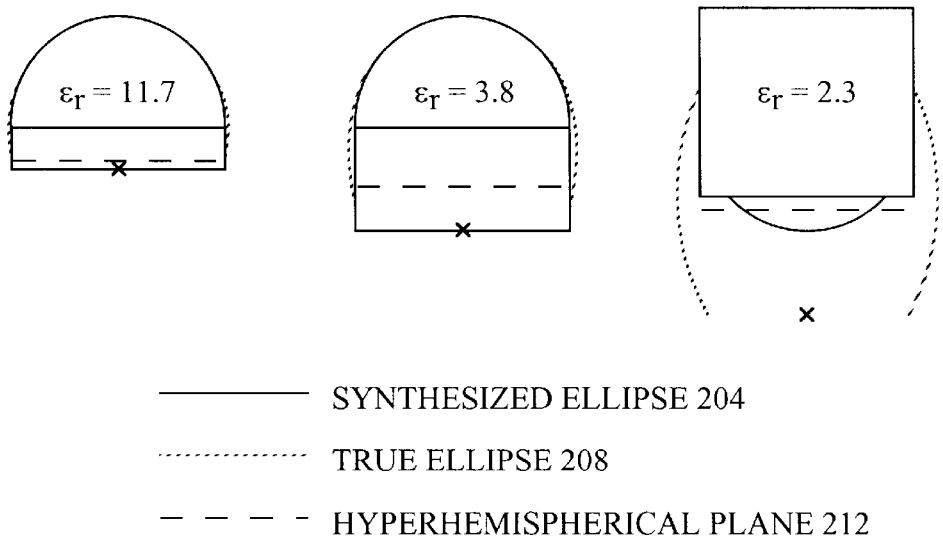
FIG. 2 is a diagram illustrating the synthesis of an elliptical lens from a hyper-hemispherical lens and planar substrates for three different materials having different dielectric constants.

FIG. 2 is a diagram illustrating the synthesis of an elliptical lens from a hyper-hemispherical lens and planar substrates for three different materials having different dielectric constants. Referring now to FIG. 2, polyethylene, quartz, and silicon, having dielectric constants of $\epsilon_r$=2.3, 4.0, and 11.7, respectively, are shown. A true ellipse 208 is synthesized by adding an extension length L to create a synthesized ellipse 204. As FIG. 2 illustrates, a higher dielectric constant yields a more exact geometrical approximation to true ellipse 208.

For a silicon lens ($\epsilon_r$=11.7), the fitted ellipse values are a=1.03 and b=1.07691. This yields an extension length of L=2670 $\mu$m for a 13.7 mm diameter lens. There are many ways to synthesize an ellipse and, as discussed below, the synthesized silicon ellipse discussed here is a very good approximation to a true elliptical lens.

Theoretical Analysis

As noted above, in one embodiment, a double-slot antenna is chosen as the example feed antenna 112 to describe an extended hemi-spherical lens 100. The double-slot antenna patterns can be calculated assuming a sinusoidal magnetic current distribution on the slot, and using an array factor in the E-plane direction. For purpose of discussion, a coordinate system is defined such that the double slots are positioned in the x-z plane with the slots pointing in the direction of the z-axis. The wavelength of the sinusoidal current distribution in the slot is approximately the geometric mean wavelength given by $\lambda_m=\lambda_0/\sqrt{\epsilon_m}$ and $\epsilon_m=(1+\epsilon_r)/2$. The current in the slot is given by:

$$I=I_{max}\sin[k_m(l-|z|)],\ -l\leqq z\leqq l,\ 2l_{max}=0.28\lambda_{air} \tag{5}$$

where $k_m=2\pi/\lambda_m$. The corresponding normalized H-plane field pattern is:

$$\frac{\sin\theta\,[\cos(k_e l\cos\theta)-\cos(k_m l)]}{k_m^2-k_e^2\cos^2\theta} \tag{6}$$

where $k_e=k_{diel}=2\pi/\lambda_{diel}$ for the dielectric side, $k_e=2\pi/\lambda_{air}$ for the air side, and θ is the angle with respect to the z-axis. The element pattern is a constant in the E-plane. The E-plane array factor is given by:

$$\cos(k_e d/2\sin\theta\cos\phi) \tag{7}$$

where ϕ is the angle from the x-axis in the x-y plane, $k_e$ is defined as above, and d is the spacing between the two slots.

Figure 3A:
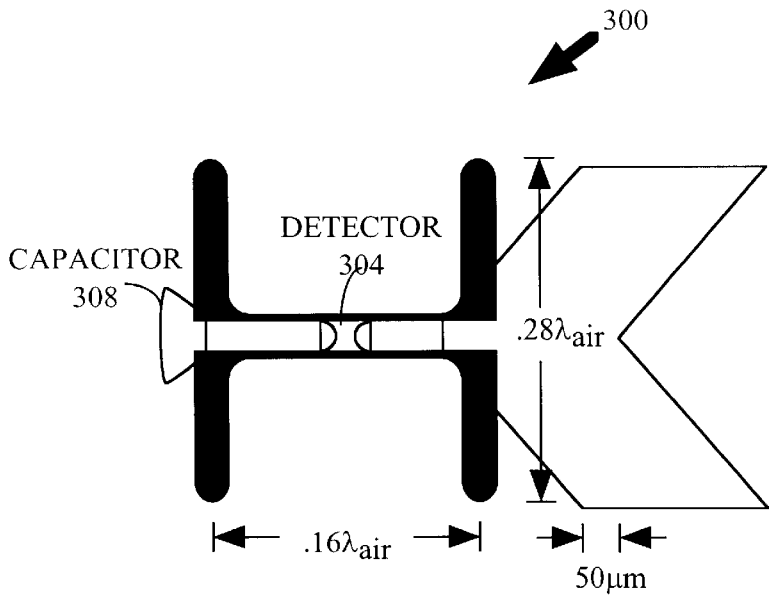
FIGS. 3A and 3B illustrate an example of double slot antenna suitable for use as a feed antenna and calculated radiation patterns at an example frequency of 246 GHz into a dielectric with a relative dielectric constant of $\epsilon_r$=11.7 for the double slot antenna.
Figure 3B:
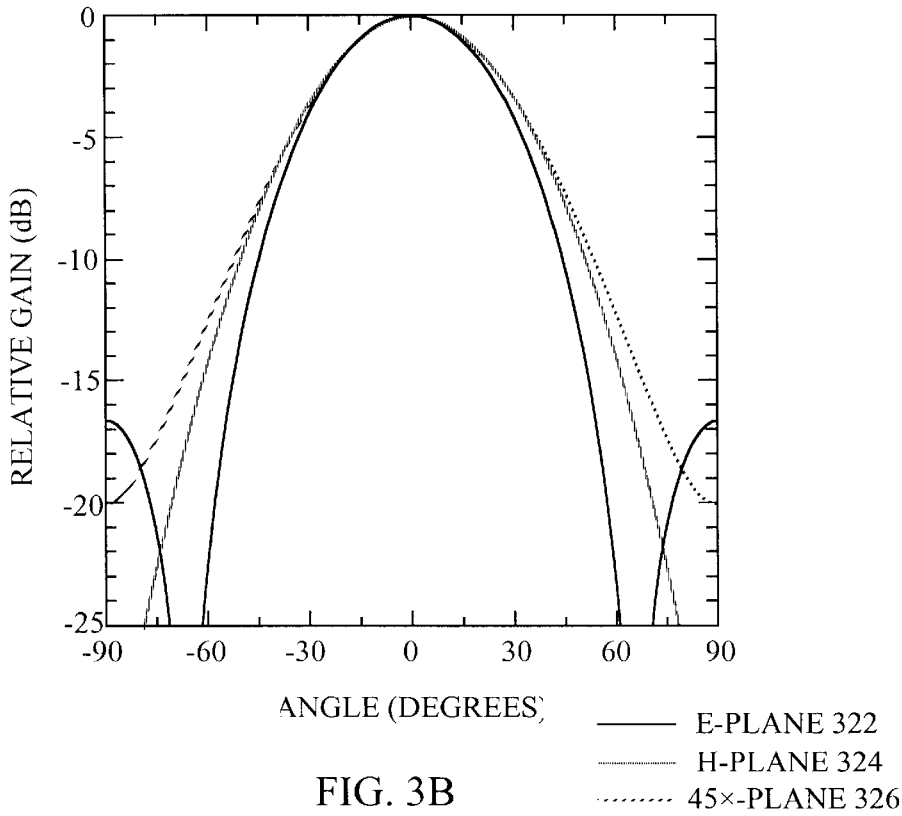

FIGS. 3A and 3B illustrate an example of double slot antenna 300 suitable for use as feed antenna 112 and calculated radiation patterns at an example frequency of 246 GHz into a dielectric with a relative dielectric constant of $\epsilon_r$=11.7 for the double slot antenna. The example double-slot antenna 300 illustrated in FIG. 3A has a length $2l=0.28\lambda_{air}$ and spacing $d=0.16\lambda_{air}$. The cross-polarization level is below −30 dB in the 45-degree plane. In the illustrated example, double slot antenna 300 includes a detector 304 and capacitor 308.

Double-slot antenna 300 results in symmetrical patterns in the infinite dielectric half space with a −10 dB beamwidth of approximately 48° and a cross-polarization level lower than −30 dB in the 45°-plane. The phase is constant across the main-beam, and, preferably, the power radiated in the main-beam illuminates the whole spherical surface of the extended hemispherical lens.

The pattern has an almost perfect fundamental Gaussian distribution (98%), and, therefore, the aberrations introduced by the extended hemispherical lens can be characterized. The patterns radiated to the air-side are broader with a −10 dB beamwidth of 70° in the H-plane 324 and a nearly uniform E-plane 322, and contain 9.0% of the radiated power.

The radiation patterns from the extended hemispherical lenses are computed using a ray-tracing technique. The double-slot antenna patterns into the dielectric are used to calculate the distribution of the electric and magnetic fields across the spherical surface of the extended hemispherical lenses. It is important to note that this analysis is not limited to double-slot antennas and is applicable to any planar antenna designed to yield similar patterns in the dielectric. Examples of such antennas can include, without limitation, the slot-ring, double-dipole and spiral/log-periodic antennas. For a given ray, the fields are decomposed into parallel/perpendicular components at the lens/air interface, and the appropriate transmission formulas are used for each mode:

$$\Gamma_{\parallel} = \frac{n\sqrt{1-n^2\sin^2\theta i} - \cos\theta i}{n\sqrt{1-n^2\sin^2\theta i} + \cos\theta i} \tag{8}$$

$$\pi_{\parallel} = (1+\Gamma_{\parallel})\frac{\cos\theta i}{\sqrt{1-n^2\sin^2\theta i}} \tag{9}$$

$$\Gamma_{\perp} = \frac{n\cos\theta i - \sqrt{1-n^2\sin^2\theta i}}{n\cos\theta i + \sqrt{1-n^2\sin^2\theta i}} \tag{10}$$

$$\tau_{\perp}=1+\Gamma_{\perp} \tag{11}$$

where n is the dielectric constant, $\theta_i$ is the angle of incidence from the normal to the spherical lens, and $\Gamma$ and $\tau$ are the reflection and transmission coefficients for the parallel ($\|$) and perpendicular ($\perp$) polarizations. Once the electric and magnetic fields have been found, equivalent electric and magnetic current densities are calculated just outside the spherical surface using:

$$J_S=\hat{n}\times H \tag{12}$$

$$M_S=-\hat{n}\times E \tag{13}$$

where $\hat{n}$ is the normal to the interface, and $\hat{n}=\hat{a}_r$ when the origin of the coordinate system is defined to be the center of the spherical surface. In the far field, the transverse electric field is equal to:

$$E_\theta \cong -\frac{jke^{-jkr}}{4\pi r}(L_\phi + \eta N_\theta) \tag{14}$$

$$E_\phi \cong +\frac{jke^{-jkr}}{4\pi r}(L_\theta - \eta N_\phi) \tag{15}$$

where N and L are defined by:

$$N = \int\int_s J_s e^{jkr'\cos\psi} ds' \tag{16}$$

$$L = \int\int_s M_s e^{jkr'\cos\psi} ds' \tag{17}$$

where s' is the closed surface just outside the lens, r' is the distance from the center of the sphere to the equivalent electric and magnetic currents, r is the distance from the center of the sphere to the far-field point, and $\psi$ is the angle between r and r'. The integrals are evaluated with respect to a coordinate system having its origin at the tip of the lens. Thus, in subsequent calculations, the far-field phase, or the near-field radius of curvature, is always referenced to the tip of the lens.

Figure 4:
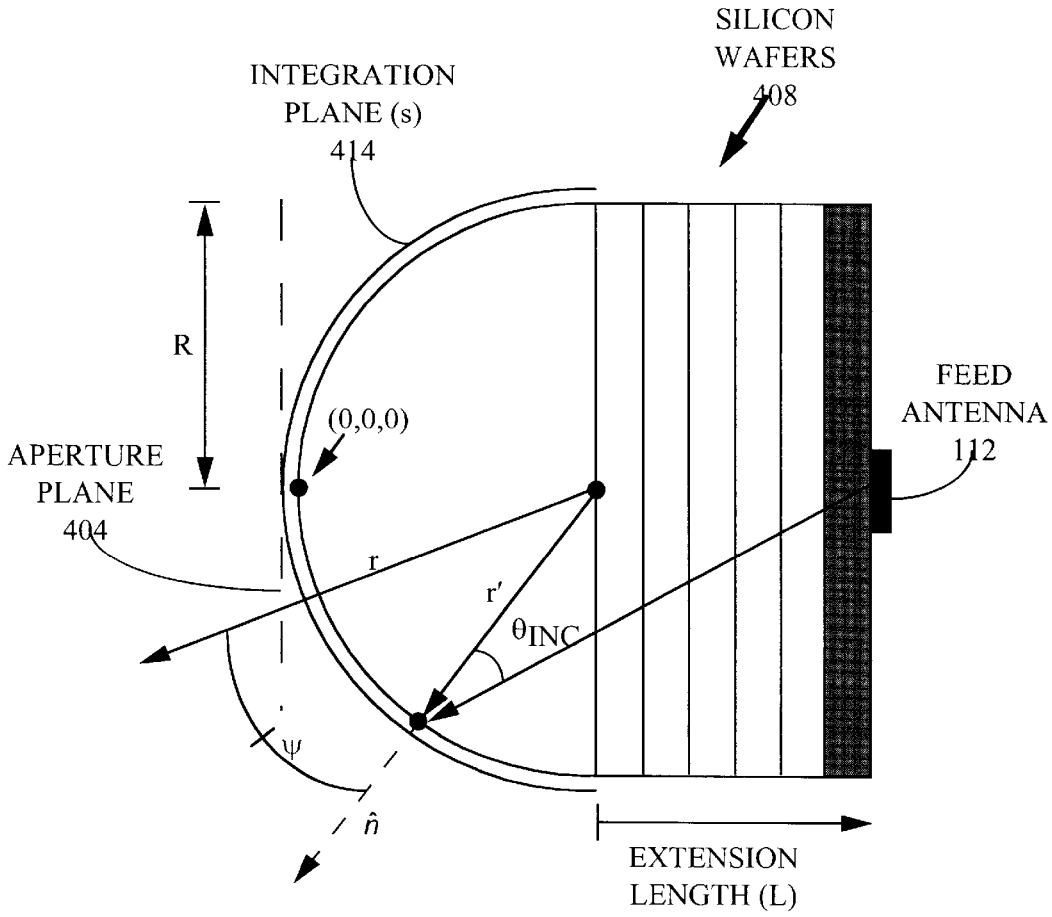
FIG. 4 is a diagram illustrating a ray-tracing/field integration technique with an extended hemispherical lens according to one embodiment of the invention.

FIG. 4 is a diagram illustrating a ray-tracing/field integration technique with an extended hemispherical lens according to one embodiment of the invention. The lens has a radius R and an extension length L. In the embodiment illustrated in FIG. 4, the extension is comprised of a plurality of silicon substrates, slices, discs, bars, slabs, or plates 408. Also illustrated in FIG. 4 are the antenna's aperture plane 404 and integration plane 414. Alternative embodiments utilize alternative configurations for the extension portion, such as, for example, a solid block of material.

Hemispherical Dielectric Lens with Improved Directivity

As described above, an extension with the appropriate length L chosen can result in improved directivity. However, moving feed antenna 112 off-center, results in a change of the effective optical path length seen by radiation or signals traversing the lens and extension. To provide beam steering, then, it would be desirable to move the feed antenna off center while maintaining a constant, or relatively constant optical path length. As such, a dielectric lens having an angled extension provides such a path and improved directivity. Such a dielectric lens is now described.

Figure 5A:
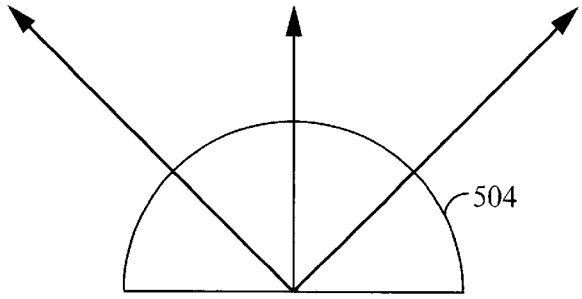
FIG. 5A PRIOR ART
FIGS. 5A through 5D illustrate a hemispherical dielectric lens with no extension, a cylindrical extension, a hemispherical extension and an angled extension, respectively.

FIGS. 5A–5D illustrate a hemispherical dielectric lens with no extension, a cylindrical extension, a hemispherical extension and an angled extension, respectively. Referring now to FIG. 5A, a conventional hemispherical dielectric lens 504 radiates energy from a feed antenna positioned at the center of the back surface of the lens. Because the feed antenna is at the center of the sphere described by the hemisphere, the direction of radiation is unchanged by the lens/air interface.

Figure 5B:
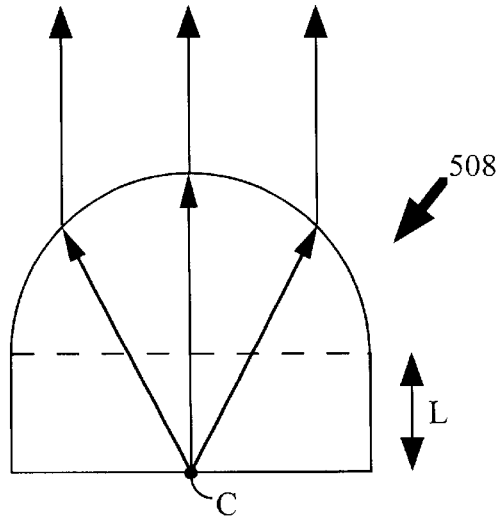

As disclosed above, an extended hemispherical lens 508 with an extension length L, as illustrated in FIG. 5B, radiates energy in one direction from an antenna position at the focus, C. As the position of the antenna is moved away from the focus C on the back surface of the extension length L, the direction of the radiation changes. However, as the position of the antenna on the back surface of the extension changes, the effective length of the path through the dielectric seen by the radiation also changes. As such, the directivity in dB of the antenna, or focus in terms of peak energy, is impacted. As discussed above, there is an optimum extension length at which the directivity is a maximum.

Figure 6:
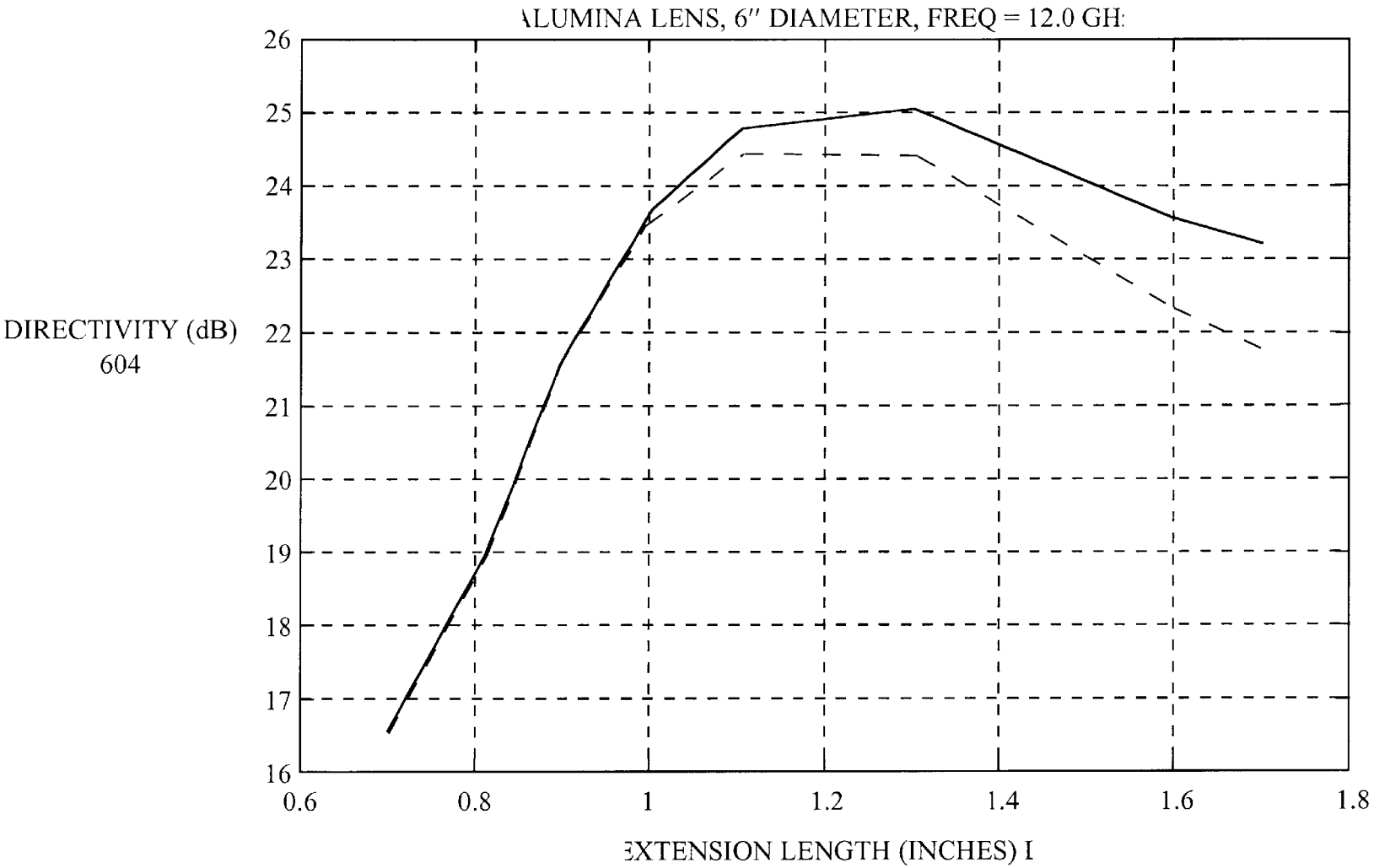
FIG. 6 is a diagram illustrating a plot of directivity versus extension length for an alumina lens.

For example, consider directivity as a function of extension length for a hemispherical lens fabricated using alumina. FIG. 6 is a diagram illustrating a plot of directivity 604 versus extension length L for an alumina lens. In particular, the plot illustrated in FIG. 6 is for an alumina lens having a diameter of 6 inches and operating at a frequency of 12 GHz. As can be seen by FIG. 6, directivity is a maximum (approximately 25 dB) at an extension length of approximately 1.3 inches. Likewise, there is a range over which the directivity 604 exceeds a defined threshold. For example, at a defined threshold of 24 dB, this threshold is met or exceeded for extension lengths of approximately 1.05 through 1.55 inches. From this, it is readily apparent that as the antenna is positioned at distances away from C, the path length traversed or traveled by the radiation increases beyond the length L, thus, altering the directivity. If L is chosen for the lens illustrated in FIG. 5B as an optimum length (for example, 1.3 inches for the lens described with reference to FIG. 6), performance will suffer as the antenna is positioned at points away from focus C.

Figure 5C:
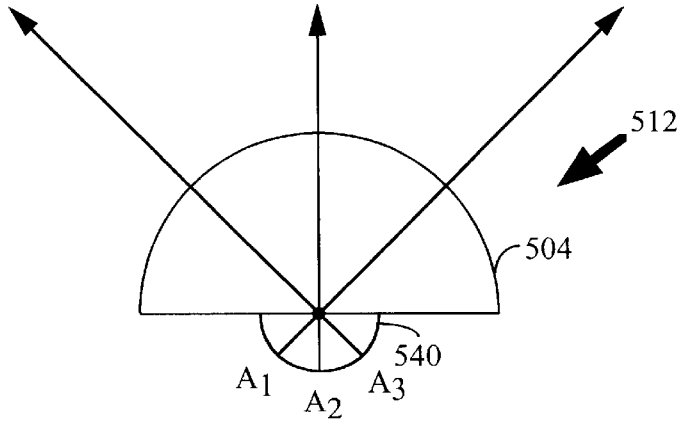

Thus, a more ideal approach would be to implement a structure such as that illustrated in FIG. 5C wherein the dielectric lens 512 is comprised of two hemispheres. Hemisphere 504 is the hemispherical dielectric lens as described above. Hemisphere 540 is a second dielectric hemisphere having a radius equal to the optimum extension length L. Placement of an antenna at different positions (for example, $A_1$, $A_2$, $A_3$) along hemisphere 540 allows direction of the antenna/lens combination (directionality), that is, the direction along which radiation is most focused or peak directivity occurs, to be altered while maintaining an ideal or more optimum extension length L. Thus, one embodiment of the invention comprises a hemispherical dielectric lens which includes a somewhat standard dielectric hemispherical lens such as lens 504 illustrated in FIG. 5A coupled with a second dielectric hemisphere which is used to provide a constant extension or optical path length through the dielectric material throughout a broad range of azimuth and elevation angles.

However, implementation of such a lens 512 in conjunction with planar antennas such as, for example, spiral antennas or slot antennas, is not ideal because the antenna would be mounted on the curved surface of hemisphere 540. Because the preferred embodiments utilize a planar antenna, it is preferable that the surface on which the antenna is mounted be planar. Unfortunately, if hemisphere 540 is replaced with a structure having one or more planar surfaces, the extension length L as seen, or the path traversed, by the antenna radiation does not remain constant across the surface of the extension as the antenna is moved across that surface.

However, a range of acceptable extension lengths L can be chosen and a surface defined to be within this acceptable range of extension lengths. As such, the extension can be implemented with a planar, or roughly planar surface, such that the directivity 604 does not fall below a desired threshold as the antenna is positioned at different locations on the planar surface.

Figure 5D:
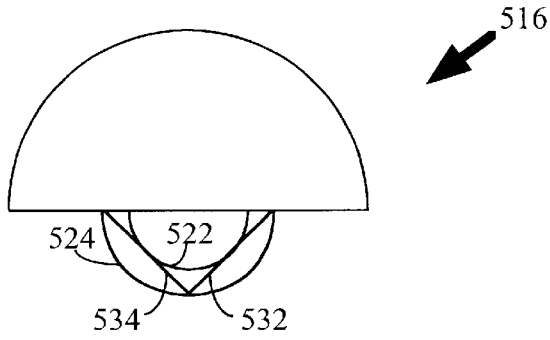

To explain, consider an example utilizing an alumina antenna with the characteristics exhibited in FIG. 6. Further assume that a desired threshold is 24.5 dB. For the alumina lens described in conjunction with FIG. 6, this means that an acceptable range of extension lengths is between approximately 1.1 and 1.3 inches. Thus, a range of acceptable extension lengths from $L_1$=1.1 inches to $L_2$=1.3 inches can be defined. These are illustrated in FIG. 5D by hemispheres 522 and 524, respectively. Planar surfaces 532, 534 can be defined within this acceptable range of extension lengths $L_1$ to $L_2$. Thus, a configuration can be implemented which provides a planar (or approximately planar) mounting surface on which to mount the antennas while maintaining an acceptable extension length.

Figure 7:
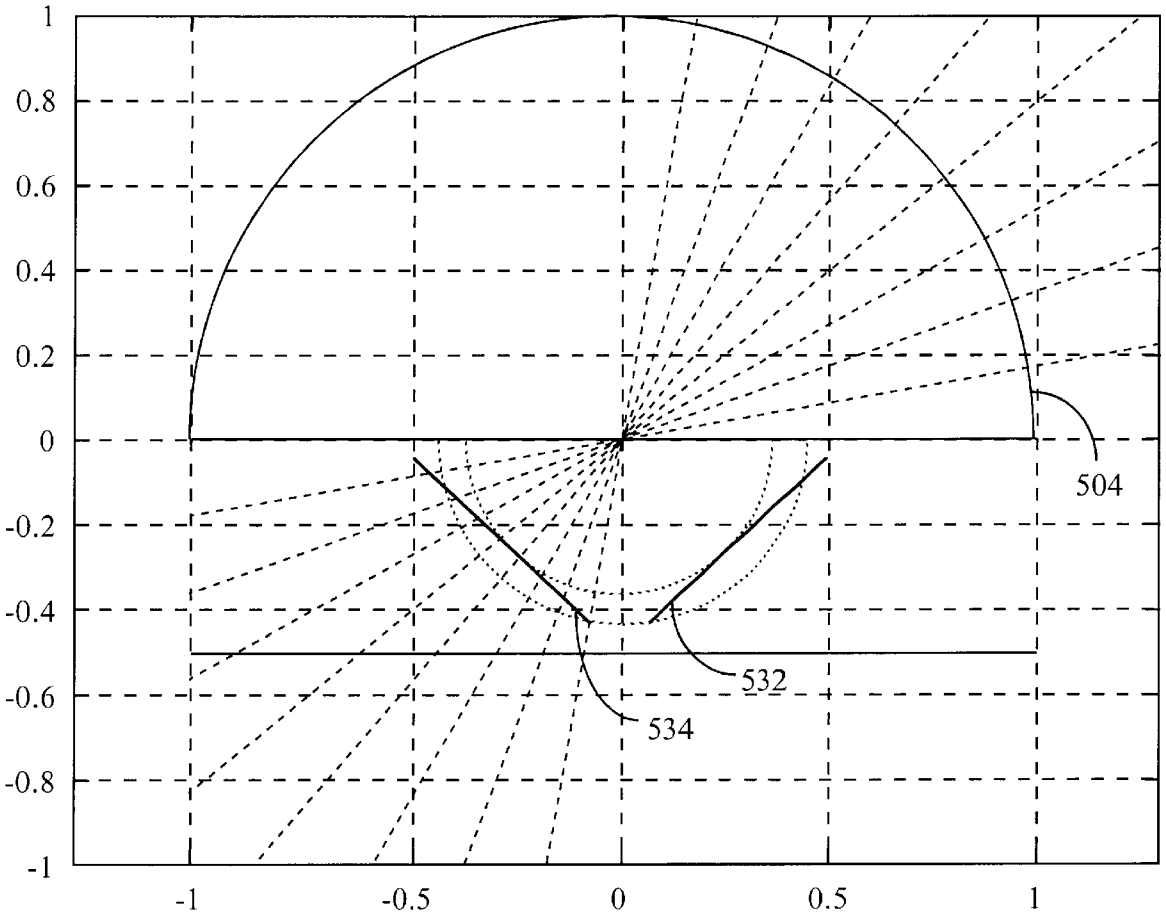
FIG. 7 is a diagram further illustrating the concept of an angled extension.

FIG. 7 is a diagram further illustrating the concept of an angled extension. The dielectric lens illustrated in FIG. 7 includes a hemispherical dielectric lens 504 and two planar surfaces 534, 532. The dashed lines indicate the radiation patterns using a ray tracing technique. To achieve a planar surface, such as surfaces 534, 532, numerous configurations can be implemented. For example, 3-, 4-, 5-, or . . . n- sided pyramids can be implemented to provide an angled extension for the dielectric lens. With such a configuration, antennas can be mounted on any or all of the surfaces of the pyramidal extension. The signal can be routed through a selected one or more of the antennas to direct the radiation in a particular direction. With an array of antennas mounted on each surface of the pyramid, the azimuth and elevation (directionality) of the antenna can be chosen by choosing one of the antennas on one of the arrays.

Figure 8:
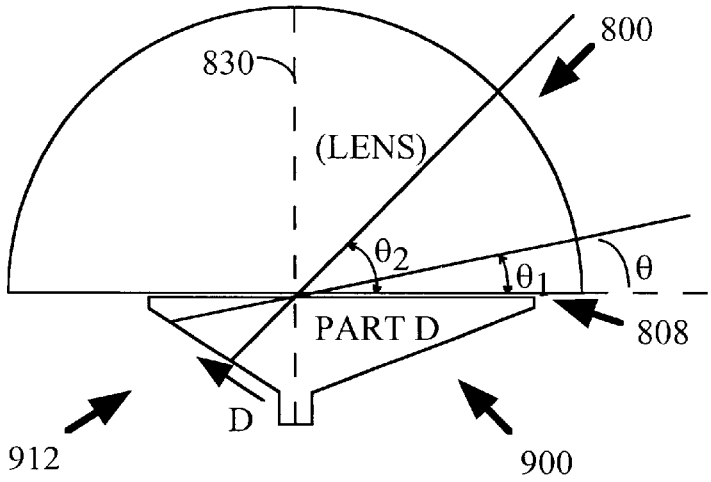
FIG. 8 is a side view of an angled extension mounted adjacent to the lens.
Figure 9:
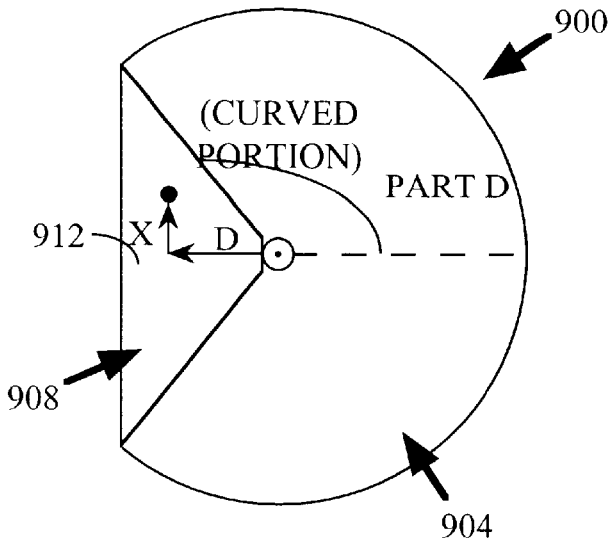
FIG. 9 is a top view of the extension of FIG. 8 having an intact curved portion with a spherical or conical shape and a cut-away portion having a planar surface.
Figure 10:
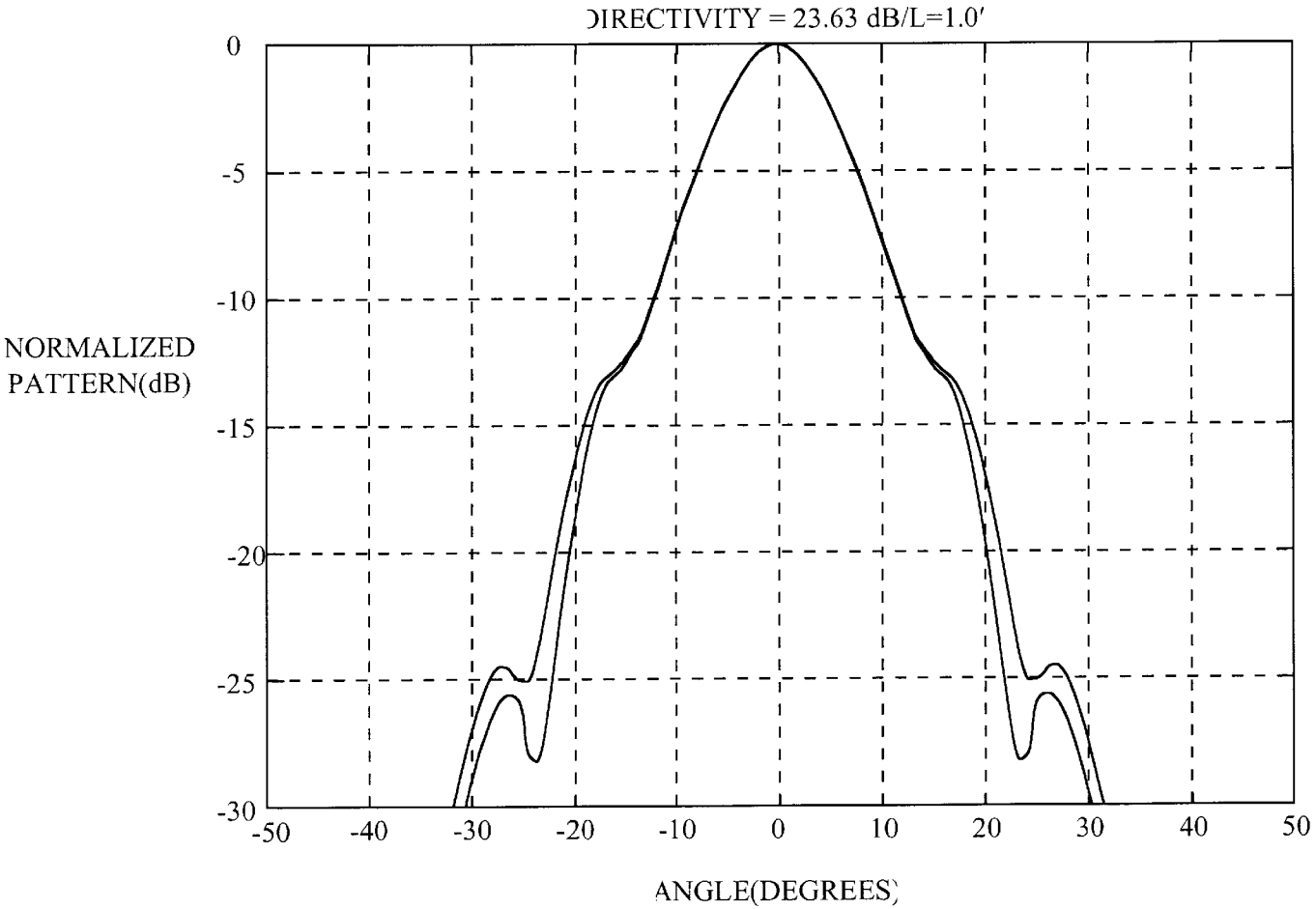
FIGS. 10, 11, 12, and 13 are diagrams illustrating normalized radiation patterns for a six-inch diameter alumina lens at extensions lengths L=1.0 inches, 1.1 inches, 1.2 inches, and 1.3 inches.
Figure 11:
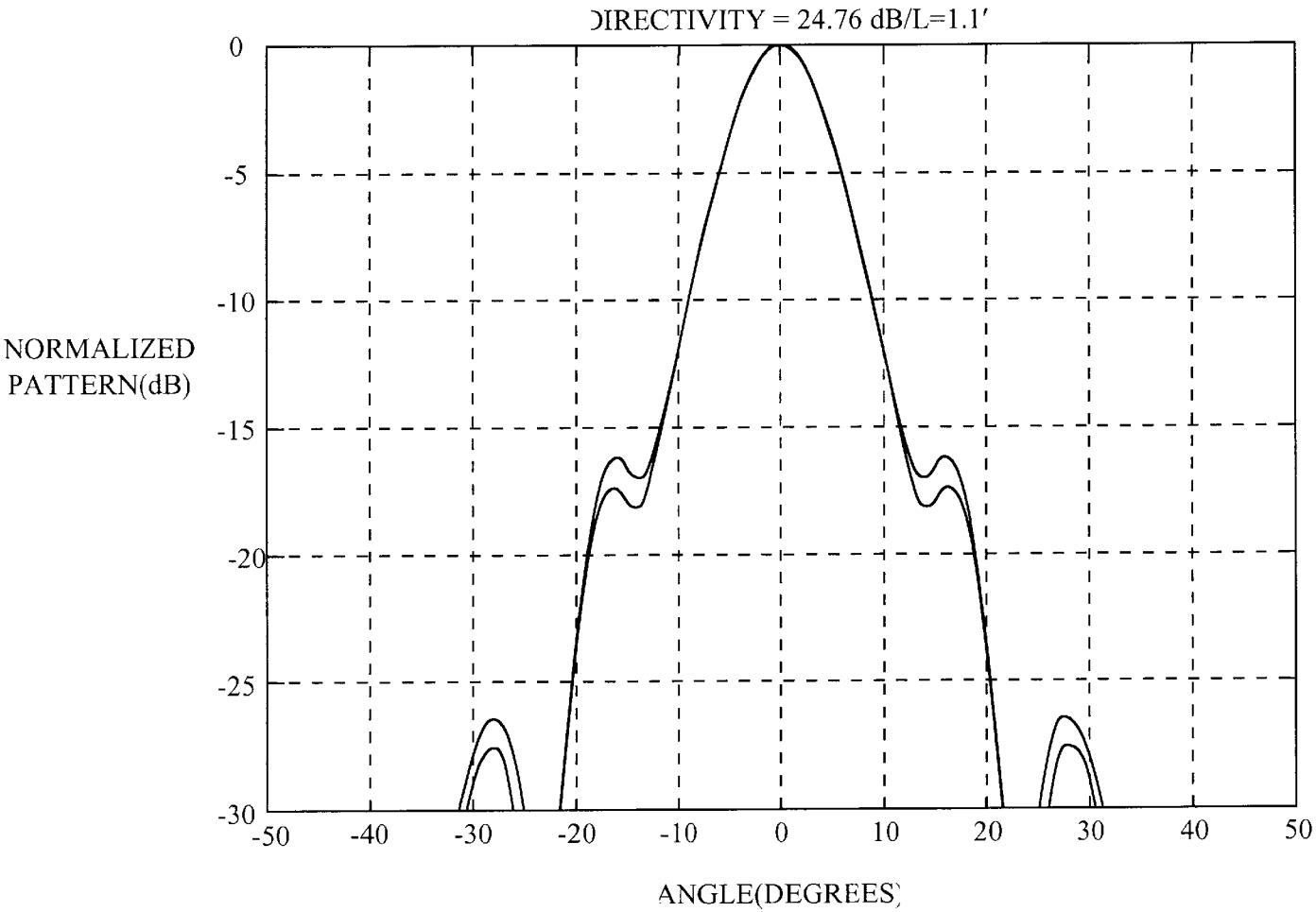
Figure 12:
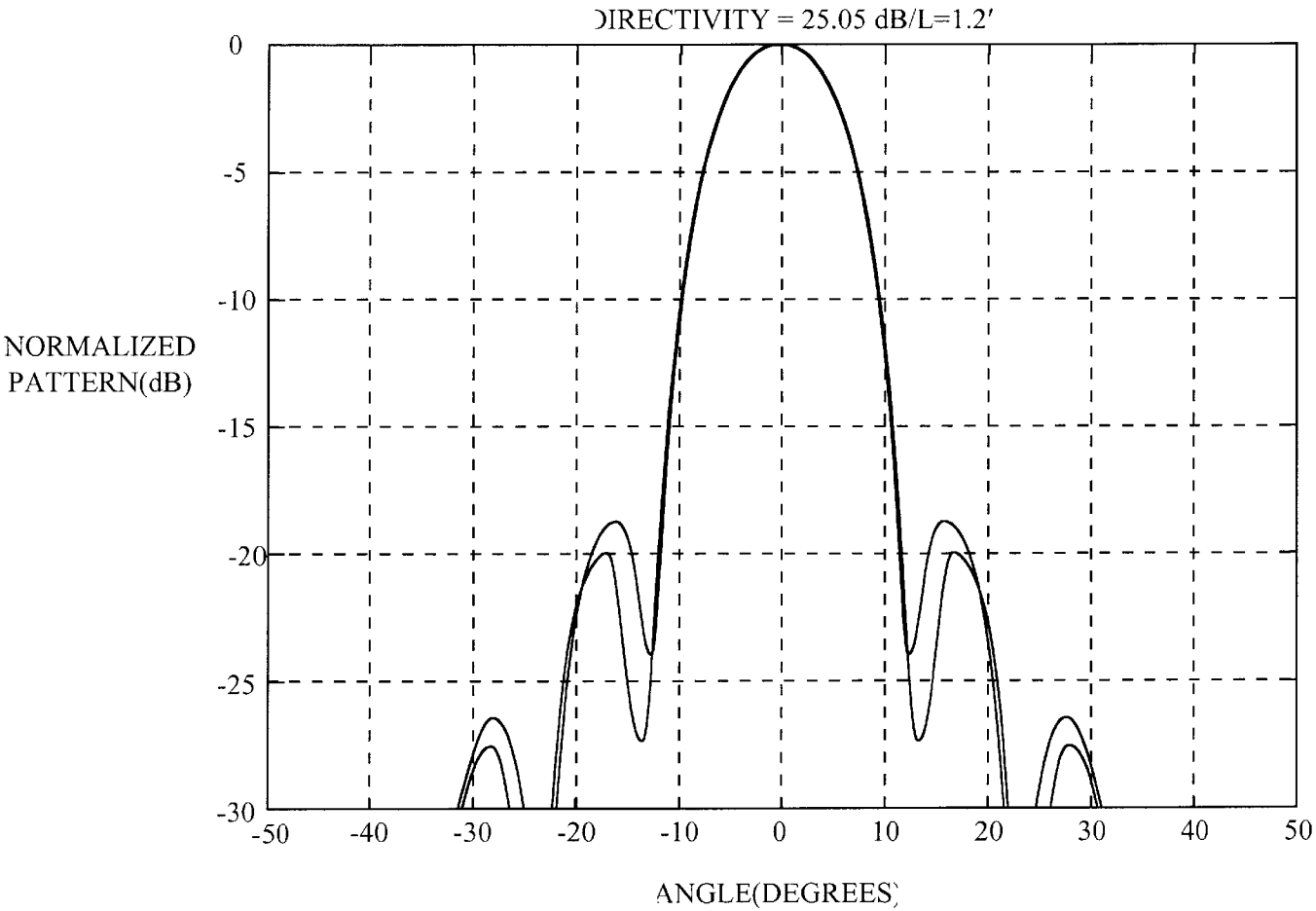
Figure 13:
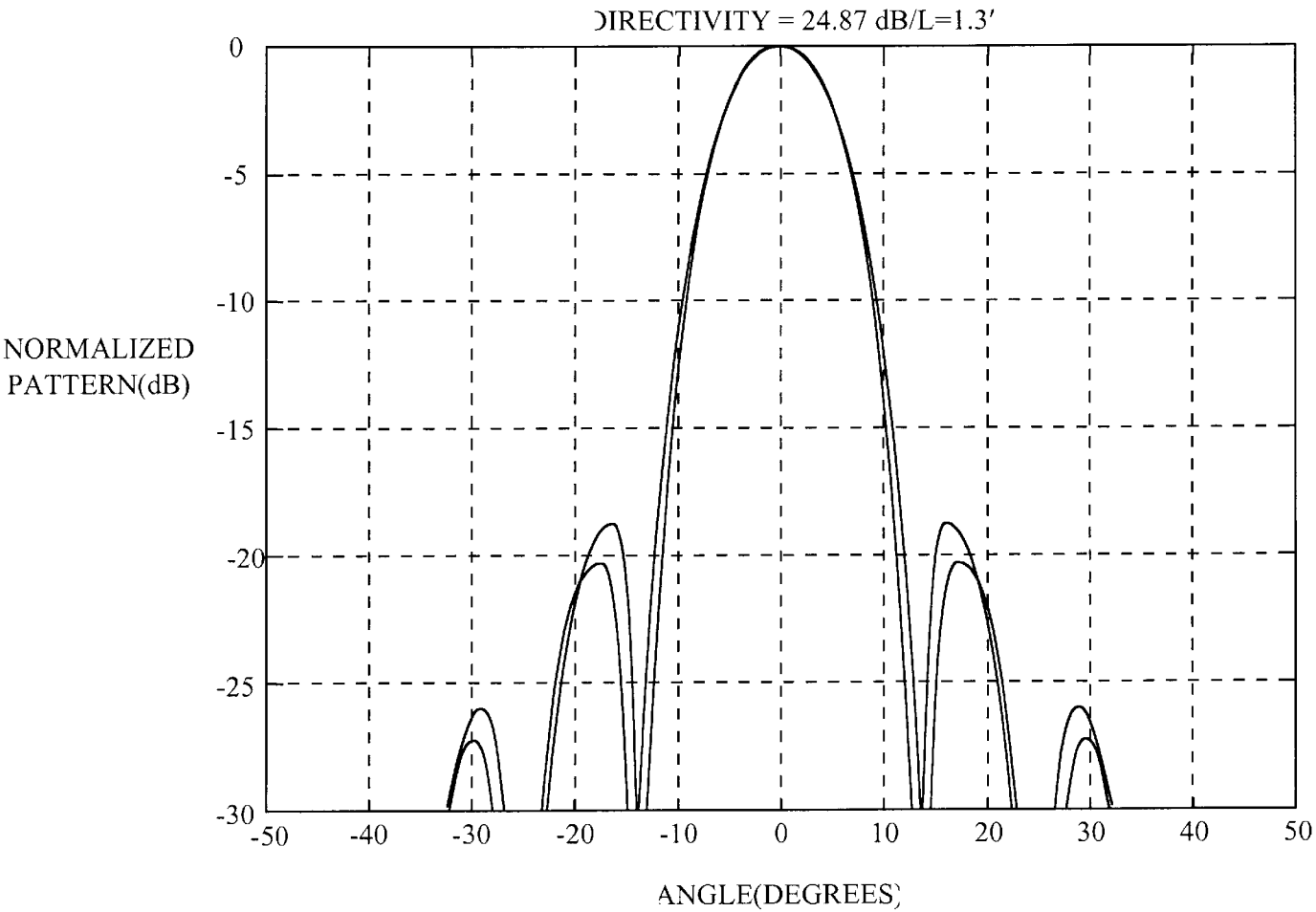

Alternatively, a preferred embodiment utilizes an extension which is conically or spherically shaped with an angled cross-section of the cone or sphere cut away to provide a planar surface. FIG. 8 illustrates a hemispherical lens 800 and an angled extension 900 in this preferred embodiment. FIG. 9 illustrates a top view of extension 900 having an intact curved portion 904 with a spherical or conical shape and a cut-away portion 908 having a planar surface 912.

FIG. 8 is a side view of extension 900 mounted adjacent to lens 800. In this preferred embodiment, one or more antennas can be mounted on surface 912. Position of the antenna along the vector D defines the angle θ of the peak directivity of the antenna. This can be described as the elevation angle of the radiated signal. Rotating extension 900 about its axis 830 varies the azimuth angle of the radiated signal. Placement of antennas on a surface such as surface 912 is described in more detail below with reference to FIG. 17.

FIGS. 10, 11, 12 and 13 are diagrams illustrating normalized radiation patterns for a six-inch diameter alumina lens at extensions lengths L=1.0 inches, 1.1 inches, 1.2 inches, and 1.3 inches, respectively. Comparison of the patterns illustrated in these figures indicate the relative directivity as a function of extension length L. FIGS. 10 through 13 were generated using antenna modeling software.

As these figures indicate, the directivity for an extension length L=1.0 inches is 23.63 dB. The pattern at this extension length L is somewhat broad, as compared to the patterns at the other extension lengths.

For an extension length of L=1.1 inches, the directivity increases to 24.76 dB. The pattern is somewhat narrower than that for an extension length of 1.0 inches and side lobes at approximately ±30° become more distinct.

For an extension length of L=1.2 inches, the directivity increases to 25.05 dB, and the pattern is much tighter with most of the radiation being centered about ±10°. Side lobes begin to appear at approximately ±18°, with additional side lobes at approximately ±30°.

For an extension length of L=1.3 inches, the directivity increases to 24.87 dB. The main lobe is still fairly narrow; however, the side lobes become more defined and some of the energy from the main lobe is lost to the side lobes.

In the embodiment described above with respect to FIG. 8, hemispherical lens 800 and extension 900 are made of alumina. Alumina is a somewhat heavy material, resulting in a heavy lens arrangement at the described six-inch diameter. With heavy materials, such as alumina, it is desirable that the system be fabricated in two parts. With this configuration, lens 800 can remain stationary. The smaller, and therefore, lighter, extension 900 is the only portion that rotates. However, the two-piece embodiment thus implemented results in an air gap 808. Alternatively, airgap 808 can be substantially occupied or filled with a low friction material, shown here as item 810.

Figure 14:
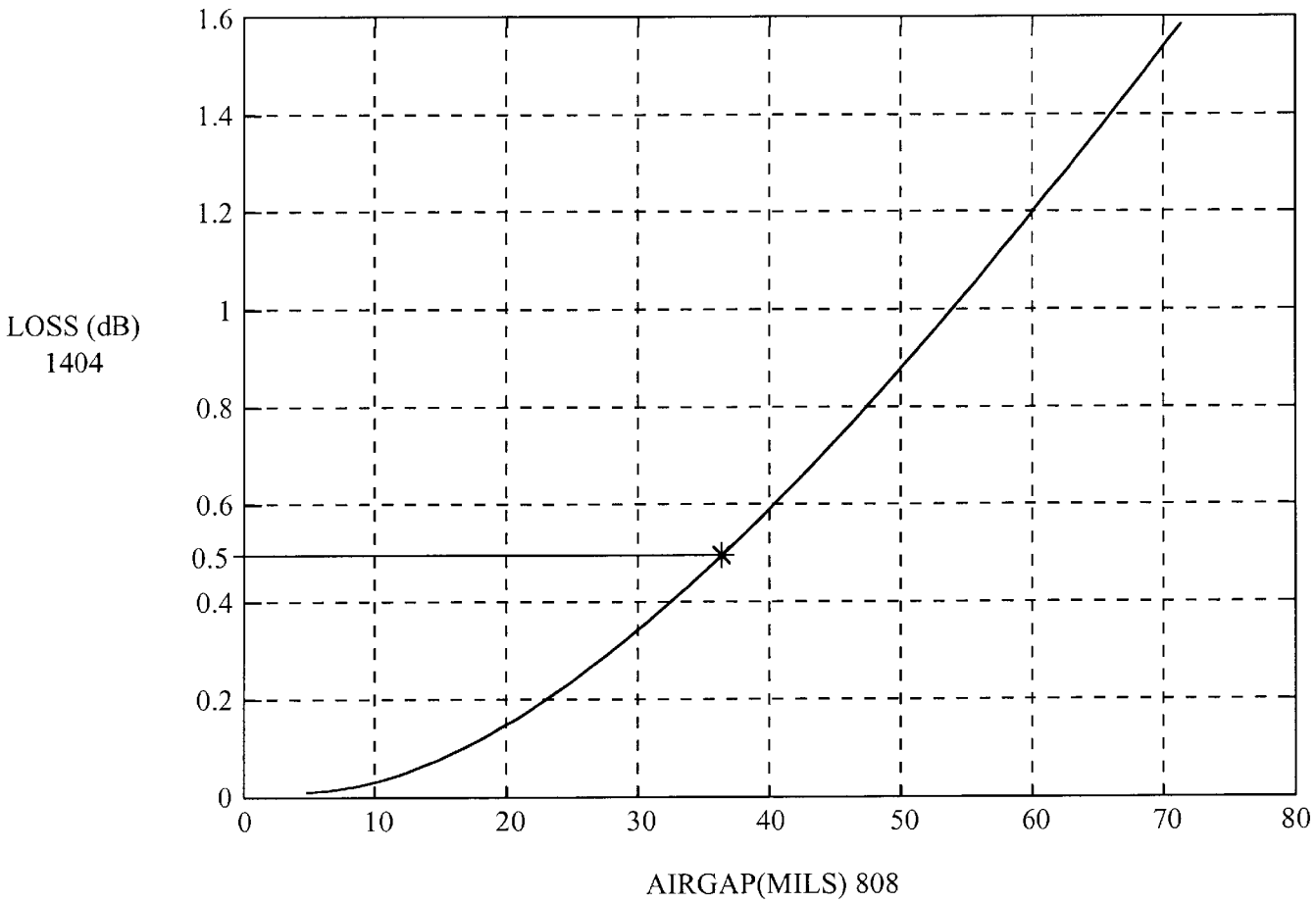
FIG. 14 is a diagram illustrating an example curve of loss versus air-gap spacing for a hemispherical lens with a dielectric extension.

FIG. 14 is a diagram illustrating an example loss curve versus air-gap spacing for a hemispherical lens with a dielectric extension configuration such as that shown in FIG. 8. Because dielectric lens 800 and extension 900 are made from two separate pieces of dielectric material, the resulting air gap 808 produces a loss in the antenna system. In FIG. 14, a loss 1404, expressed in dB's, is plotted versus the length of air gap 808, expressed in mils. As can be seen in FIG. 14, as the length air gap 808 increases, so does the loss of the antenna system. Therefore, it is preferred to keep air gap 808 as small as possible.

However, if air gap 808 becomes too small, the effects of friction come into play, making it difficult to rotate extension 900 about the axis. In some embodiments, it may be practical to use a matching fluid between hemispherical lens 800 and extension 900 to minimize the air-gap loss induced by the difference in dielectric constants of the lens material and the air. However, as would be apparent, it is not always practical to use such a matching fluid. Alternatively, a thin layer of material having an appropriate dielectric constant and a low friction surface, for polytetraflouroethylene, commercially available under the name Teflon, could prove useful for some applications.

Alternative embodiments of the present invention utilize a one-piece structure or an integrated structure where lens portion 800 and extension portion 900 are fabricated either from a single piece of material or are otherwise physically connected such that it is necessary to rotate the entire structure in order to provide the radiation in the desired direction. In the one piece embodiments, there is no air gap. In embodiments where two pieces are connected to rotate together, friction is not an issue and the air gap can be made very small. In these types of embodiments, air gap loss is not a major factor.

In other alternative embodiments of the present invention lens portion 800 and extension portion 900 are fabricated from a lightweight material, such as, but not limited to a ceramic polymer or other composite material having desirable dielectric properties. Specialized ceramics and other materials may be much lighter than the alumina used in the earlier examples, thus, a one-piece structure, an integrated structure, or individual components would produce light enough antenna lenses that rotation would be fairly easy. Higher speed, quicker, or less cumbersome (lower inertia) rotation for a given motive force could be realized.

Those skilled in the art will readily recognize that the choice of material and impact of weight are determined in part by the specific application of interest. Weight is not an issue for many applications of a directional antenna, and does not affect material choice. This would include applications where antennas are used on homes or other buildings and structures, on transportable structures and containers, or on larger vehicles including ships and trains, where weight is not as much a limiting factor as it might be in some applications.

Alternate embodiments of the present invention utilize lens portion 800 made of layers of different dielectric materials to affect the index of refraction. In these embodiments, the index of the material is substantially constant over a given radius of the hemisphere.

Planar Antenna Implementations

Many of the embodiments described above were described in terms of a double-slot antenna. As discussed, however, alternative antenna arrangements can be utilized with the dielectric lens to achieve the same or similar results. Preferably, the antennas utilized are planar antennas, because they occupy little space and provide good coupling into the dielectric lens. In one embodiment, coupling efficiency is improved by including a ground plane for the antenna opposite the dielectric lens.

Figure 15:
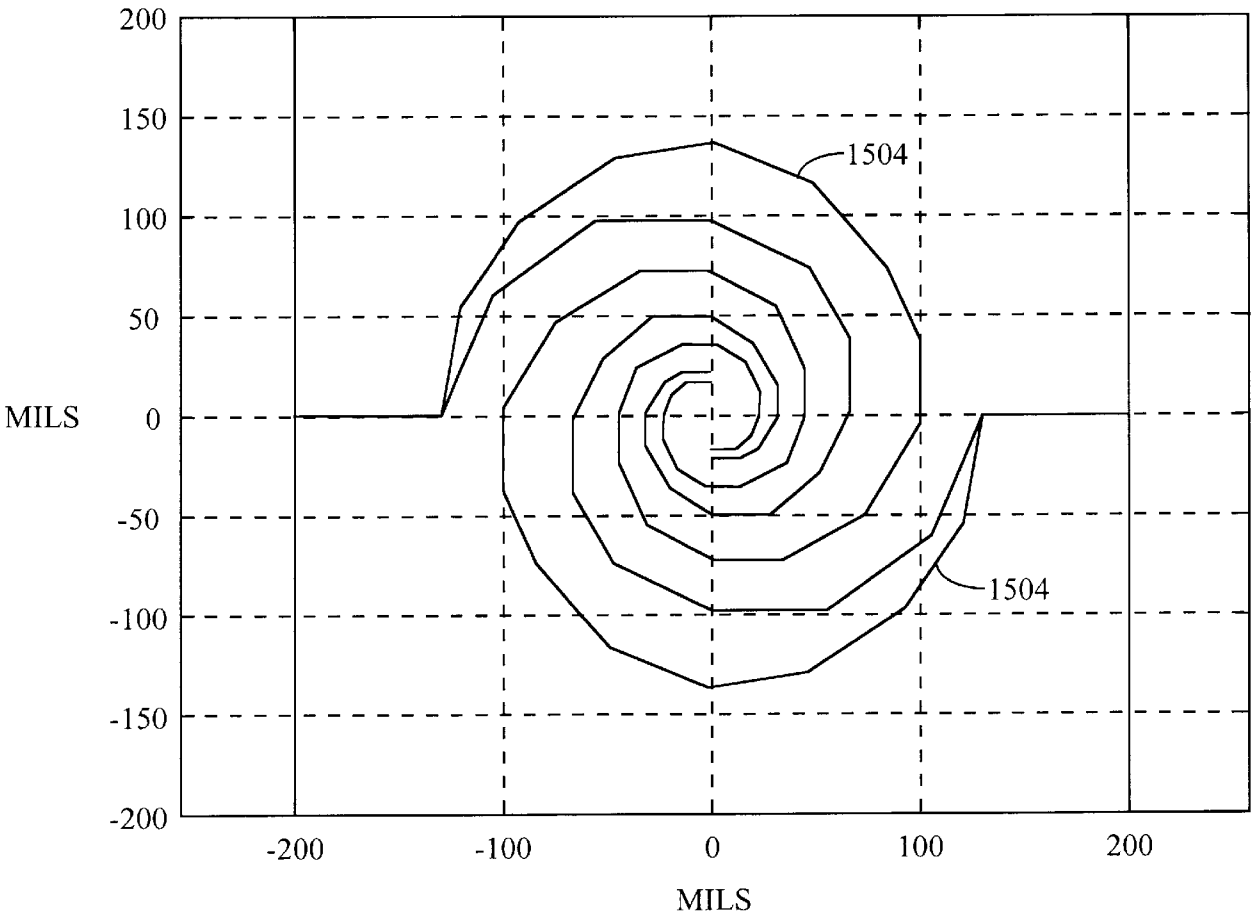
FIG. 15 is a line diagram illustrating an example configuration for a spiral antenna.
Figure 16:
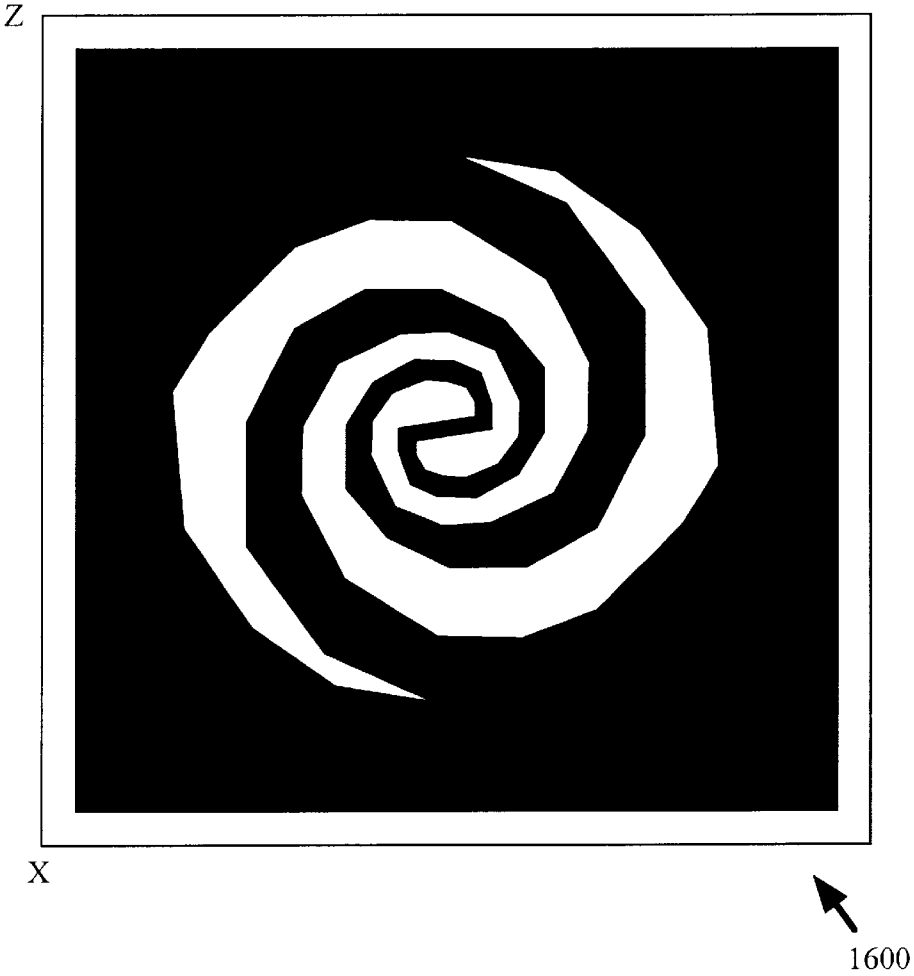
FIG. 16 shows an example implementation for a complementary implementation of a spiral antenna.

One antenna which is well suited for use with the dielectric lens embodiments disclosed above is a spiral antenna. FIG. 15 is a line diagram illustrating an example configuration for such a spiral antenna. Referring now to FIG. 15, the example spiral antenna is a two-arm, center-fed, infinite balun antenna having two arms 1504 as radiators. In one embodiment, the spiral antenna is implemented as a complementary antenna. Spiral antenna can be implemented as either right-hand or left-hand circularly polarized. In one embodiment, each arm 1504 of the spiral antenna is a quarter wavelength in length. An example implementation for a complementary implementation of weight is not an issue a spiral antenna is illustrated in FIG. 16. That is, in FIG. 16 arms 1604 represent openings or spiral shaped gaps in a conductive layer 1606 of material disposed on a support substrate. Such antennas are well known in the art.

In one embodiment, a dielectric radome is used in conjunction with the hemispherical lens. The dielectric radome can be implemented as a matching layer to eliminate or minimize reflection losses at the lens/air interface. In a preferred embodiment, the dielectric radome has a thickness of one quarter of a wavelength of the desired operating frequency.

Figure 17A:
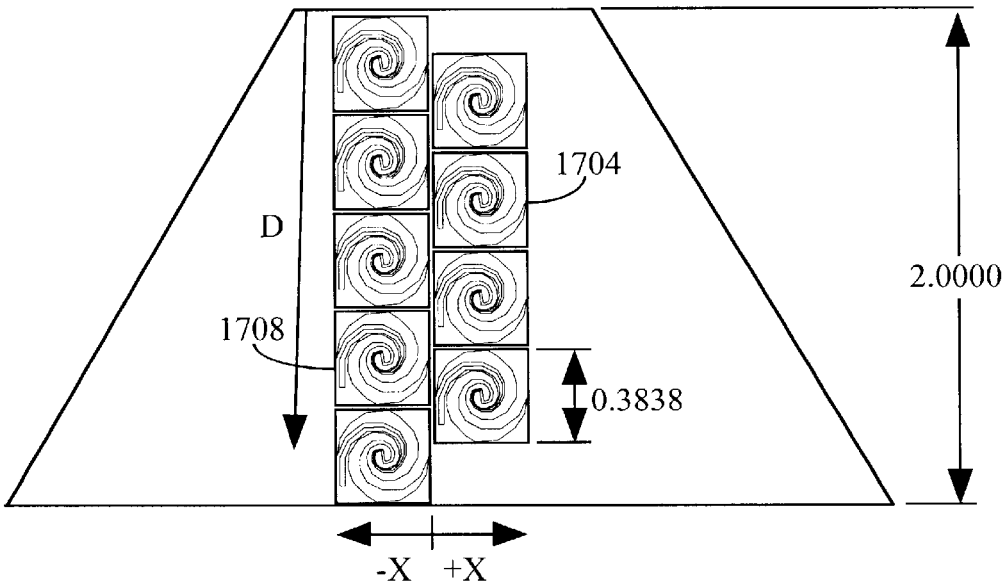
FIG. 17A illustrates a plurality of spiral antennas positioned on a surface of the extension.
Figure 17B:
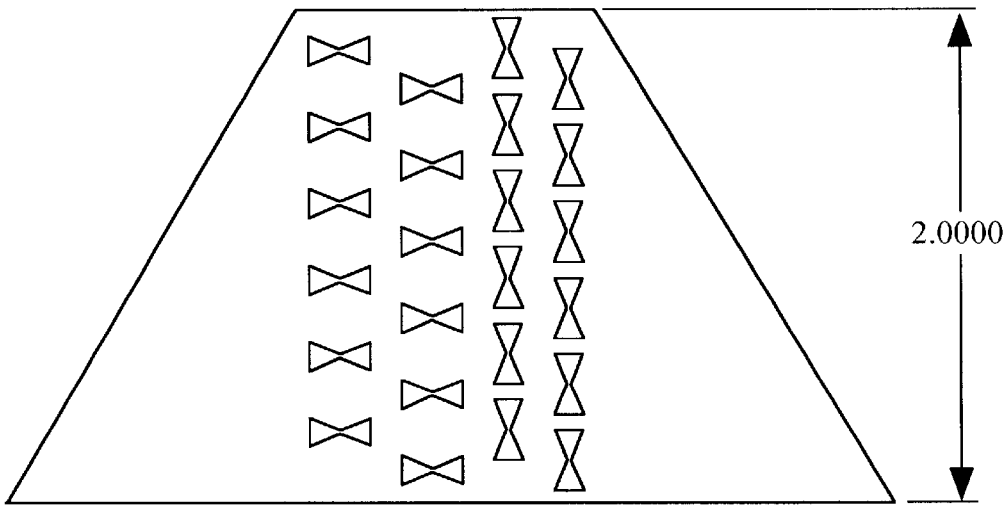
FIG. 17B illustrates a plurality of "bow-tie" type dipole antennas positioned on a surface of the extension.

FIGS. 17A and 17B illustrate two exemplary configurations for positioning antennas on the surface of an extension such as extension 900 or surfaces 532 and 534. FIG. 17A illustrates a plurality of spiral antennas positioned on a surface of the extension. Alternative arrangements and configurations can be implemented. FIG. 17C, illustrates a plurality of bow tie antennas as opposed to spiral antennas. After reading the description below, it will become apparent to one skilled in the art how to implement the dielectric lens of the invention with alternative antenna arrangements.

In FIGS. 17A–17B the antennas are laid out on the surface as an array of antennas. The array can be comprised of any number of rows and/or columns of antennas. However, the most desirable mode of operation is achieved by laying the antennas from the center of the surface along the D axis such that the radiation through the center of the hemisphere described by the lens is maximized. As such, the embodiments illustrated in FIGS. 17A and 17B provide antennas at the center line of the surface. The antennas arranged in this manner are described as being laid out in the D direction from one end of the planar surface to the other, and in the ±X direction from the D axis of the planar surface outward. Choosing an antenna along the D direction allows selection of a directed beam at a given elevation angle $\theta$.

For example, referring to FIG. 17A and FIG. 8, selection of antenna 1704 results in radiation at an angle $\theta_2$, while selection of antenna 1708 results in radiation at a direction $\theta_1$. Offsetting the antennas in the +X and the −X directions as illustrated allows for finer resolution and antenna placement in the D direction. This provides for greater resolution in selection of angle $\theta$.

Figure 18:
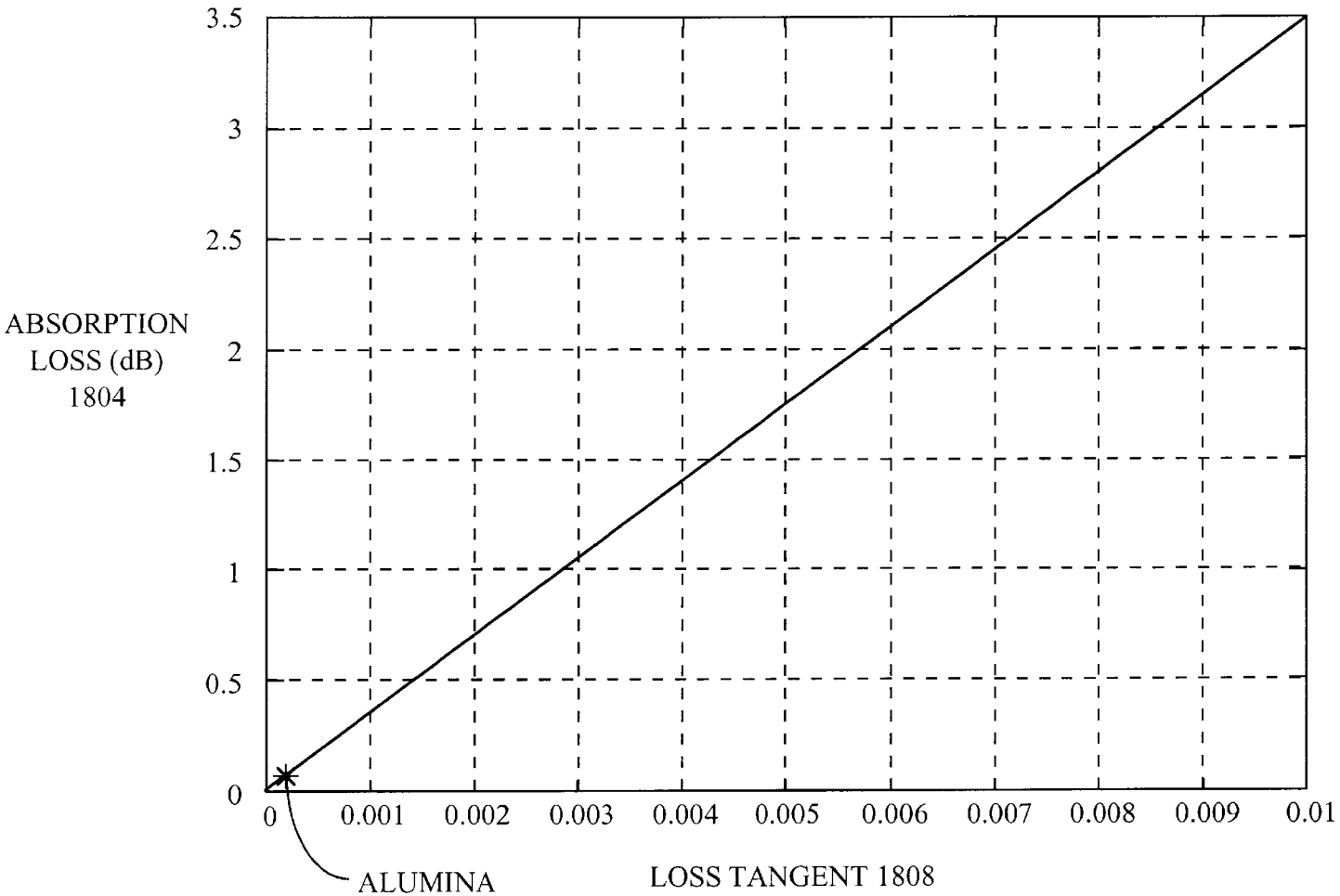
FIG. 18 is a diagram illustrating absorption loss 1804 versus loss tangent 1808 of the dielectric material.

Another factor to consider when implementing the dielectric lens is the absorption loss of the lens as a function of the loss tangent of material. FIG. 18 is a diagram illustrating absorption loss 1804 versus loss tangent 1808 of the dielectric material.

Figure 19:
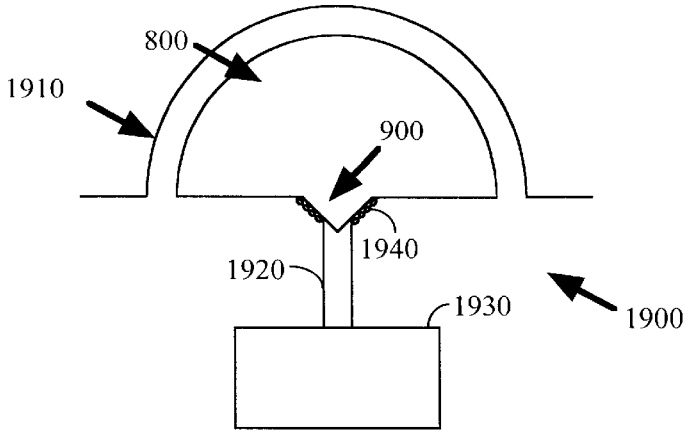
FIG. 19 illustrates an antenna system according to one embodiment of the present invention.

FIG. 19 illustrates an antenna system 1900 according to one embodiment of the present invention. Antenna system 1900 includes a dielectric lens having a hemispherical lens portion 800 and an extension portion 900, a radome 1910, a shaft 1920, a motor 1930, and one or more antenna elements 1940. Antenna elements 1940 are mounted on extension portion 900 as discussed above. Shaft 1920 couples extension portion 900 and lens portion 800 to motor 1930, or other known source of motive or rotational power. In this manner, motor 1930 can rotate the dielectric lens thereby changing its direction, as discussed above.

In the embodiment shown in FIG. 19, lens portion 800 and extension portion 900 are formed from the same material, or are fixedly attached to one another. In this embodiment, lens portion 800 and extension portion 900 rotate together. However, as discussed above, in alternate embodiments of the present invention, lens portion 800 and extension portion 900 might be separate pieces. In these alternate embodiments, lens portion 800 is fixed and only extension portion 900 is coupled to motor 1930, or other rotational driver, via shaft 1920. Thus, only extension portion 900 rotates to change the direction of the dielectric lens.

It will be readily apparent to those skilled in the art that a variety of well known motors, gears, belts, shafts, and mechanical supports can be used to secure, or support the lens portion and extension in place and rotate one or the other as desired. Therefore, additional discussion of such known elements is omitted here.

Radome 1910 is matched to lens portion 800 so that the thickness of the radome material is preferably one-quarter of the wavelength of interest for the radiation, in order to minimize reflection and maximize energy transmitted from the antenna as would be apparent. The air gap between the lens and the radome will also be preferably minimized.

Figure 20:
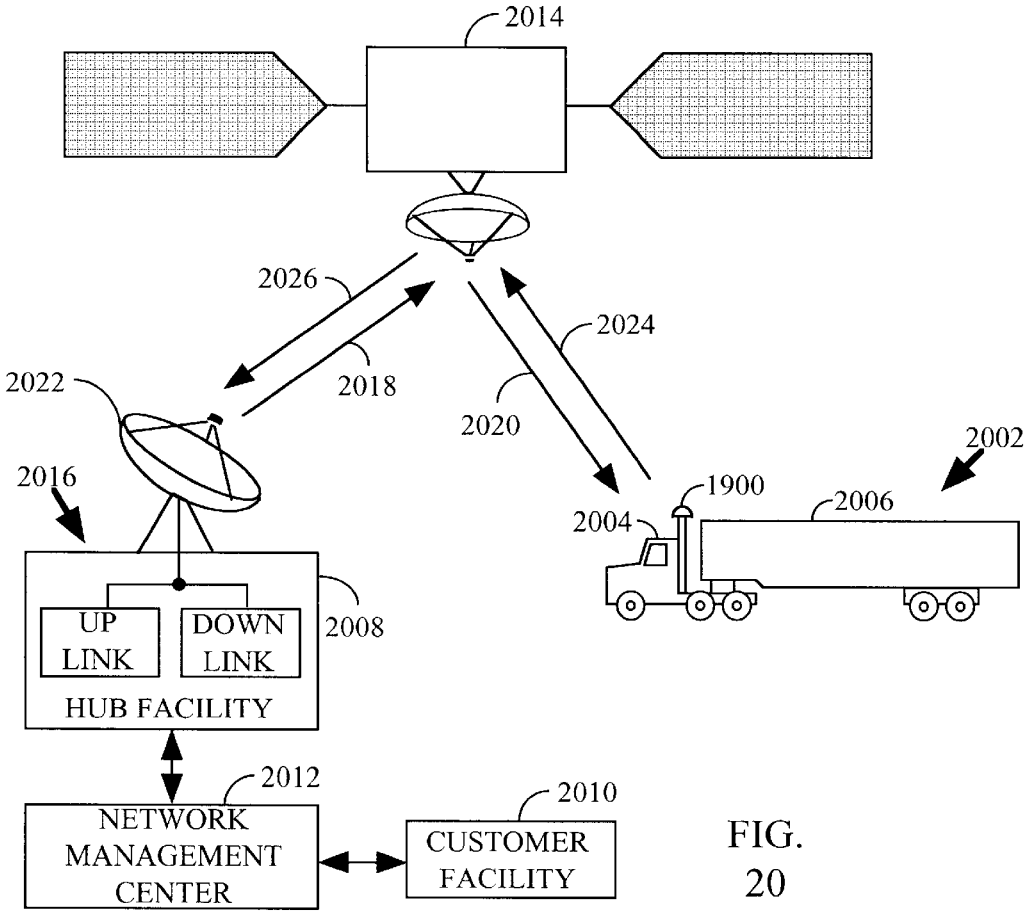
FIG. 20 illustrates a communication system that uses the antenna system according to one embodiment of the present invention.

FIG. 20 illustrates an exemplary communication system environment in which the present invention may operate. In FIG. 20, a communication system 2000 is illustrated having a known mobile terminal, receiver, or transceiver (not shown) mounted in a vehicle such as a truck 2002. Truck 2002 represents any of a variety of vehicles whose occupants desire to obtain occasional or updated information, status reports, or messages from a central communication source. Truck drivers or various drayage personnel often have a need for ready access to messages for more efficient operation.

However, it should be understood that the transceiver may be used in association with any type of vehicle or transportable unit that would have need of an automatically adjusting antenna for acquiring different signal sources, such as but not limited to satellites, in different positions. Further, the transceiver could also be used to find other repeaters or any other source on the ground for narrow aperture systems. In another embodiment of the present invention, communication system 2000 is mounted at a fixed location such as a house or other building to thereby provide satellite communications with the inhabitants or various equipment located inside. Small aperture antennas have a variety of applications that can now be realized by using the lens and scanning capabilities of the present invention.

Communication system 2000 may also make it possible to have a mobile system user, such as an occupant of truck 2002, be able to communicate at least some form of limited message or acknowledgment to a central control station. Such messages may be unsolicited messages provided from the truck or messages generated in response to received messages. A reply message may prevent the need for further communications, or indicate a need for additional information or updated messages from new information provided by the vehicle driver. At the same time, by providing for a return link of communication, even if limited in content, it is possible to incorporate other features into the communication link. Such a return link communication may be in the form of a simple message of acknowledgment to provide verification of a message received by the terminal, whether or not the driver operates on the information.

Automatic responses may also be configured into the operation of the transceiver such as vehicle location, vehicle status, trailer identification or trailer status. The return link can also allow a driver to enter messages such as verification of time and delivery information, or a report on current position or other status information. Information about the route taken or driver activities can also be transmitted as desired.

Truck 2002, as illustrated in FIG. 20, includes a tractor 2004 and a trailer 2006, although it is understood that more or fewer trailers may be utilized. In the operation of the communications system, a message is transmitted between truck 2002 and central transmission facilities or terminal 2008, also referred to as a hub.

Hub 2008 is typically located in a location well suited for low interference ground-to-satellite transmission or reception. This location can be a remote location, however, only a clear line-of-sight to the satellite is needed. When geosynchronous satellites are used, they are typically at very high elevations, also referred to as "look angles" to the hub. The location of the hub depends on the track of the satellite used or the orbital plane or position of the satellite, as is well known.

Communication system 2000 is described with respect to acquiring and tracking a signal from a geosynchronous satellite. However, it would be apparent to one skilled in the relevant art, that the present invention could also be used to acquire and track signals from certain lower Earth orbit (LEO) and medium Earth orbit (MEO) satellites, as long as the speed of the satellite is such that its signal can be initially acquired and re-acquired after elevation scanning, by an azimuthal searching process. Furthermore, the present invention can be used to acquire and track signals from a local repeater or from any other signal source. The antenna can be used in acquiring a signal from a slowly moving source, or where the source remains relatively fixed, but the object supporting the antenna moves, either periodically or on miscellaneous occasions.

One or more system user facilities, i.e. customer facility 2010, in the form of central dispatch offices, message centers, or communication offices, are tied through telephonic, optical, satellite, or other dedicated communication links to hub 2008 via network management center 2012. Network management center 2012 can be employed to more efficiently control the priority, access, accounting, and transfer characteristics of message data. Network management center 2012 is typically located at the same location as hub 2008.

Network management center 2012 is interfaced to existing communication systems using well known interface equipment such as high speed modems or codecs to feed message signals into the communication system. Network management center 2012 utilizes high speed data management computers to determine message priorities, authorization, length, type, accounting details, and otherwise control access to the communication system.

Hub 2008 employs a transceiver to establish forward and return links or up and down link communication paths with a geosynchronous Earth orbiting satellite 2014. In one embodiment, hub 2008 uses an Extremely High Frequency (EHF) transceiver to establish these links. In another embodiment, C (approximately 6 GHz) or Ku (approximately 12 GHz) band transceivers may be used. However, other bands are also contemplated to be used with the present invention. These links are maintained at one or more of a number of preselected frequencies or frequency ranges. A typical satellite system employs a series of repeater transponders for transmitting 12 GHz frequency signals for TV or radio transmissions to ground stations. More recently, a new class of communication systems using constellations of LEO satellites are being developed.

Hub 2008 transmits a signal through a diplexer 2016 to an antenna 2022. In an alternate embodiment, a separate receive/transmit train could be used, depending on costs and other known design factors, as would be apparent to one skilled in the relevant art. Antenna 2022 comprises a very small aperture antenna for directing a communications signal to a single orbiting satellite.

A forward link communication signal 2018 is transmitted through antenna 2022 to communications satellite 2014 at the preselected uplink carrier frequency. Communication signal 2018 is received by repeater satellite 2014 where it may be translated to a second frequency for downlink transmission 2020. Those skilled in the art of communications understand the apparatus needed to perform this reception and conversion function which are known in the art. Using different frequencies for the uplink and downlink communication signals reduces interference.

The transmitted forward downlink signal 2020 is received by a mobile transceiver or receiver (not shown) through a small, generally directional antenna 1528. Return uplink signal 2024 and corresponding return downlink signal 2026 are passed along substantially the same path as the forward signals via satellite 2014. Further details of the forward and return communication links are described in U.S. Pat. No. 4,979,170, entitled "Alternating Sequential Half Duplex Communication System," issued on Dec. 18, 1990, which is incorporated herein by reference.

Operating in a communication system environment such as that depicted in FIG. 20, communication may be provided from the mobile terminal in truck 2002 to customer facility 2010 to include trailer identification and load status information. Position of tractor 2004 or alternatively, position of tractor 2004 and trailer 2006 may be obtained through use of Global Positioning Satellites (GPS). It will be apparent to one skilled in the art of communication the apparatus needed to implement such a GPS system. Alternately, position of tractor 2004 and trailer 2006 may be obtained through a process as described in U.S. Pat. No. 5,017,926, entitled "Dual Satellite Navigation System," issued May 21, 1991 to Ames et al., which is incorporated herein by reference. In an alternate embodiment, newer LEO communication satellite systems may be used for determining position. In this embodiment, the signal strengths and timing may be reported to hub 2008 by the transceiver, where the position of tractor 2004 and trailer 2006 are computed.

Antenna system 1900 is mounted on truck 2002 so that it is capable of being continuously rotated through a 360° arc to have or obtain an unobstructed field-of-view of satellite 2014. Antenna system 1900 is connected to an antenna pointing and tracking control system (not shown) for tracking satellite 2014 as truck 2002 changes position relative to the satellite. An exemplary antenna rotation mechanism is found in U.S. Pat. No. 4,876,554, entitled "Pillbox Antenna And Antenna Assembly," issued Oct. 24, 1989, to Duane Tubbs, which is incorporated herein by reference.

Based on the discussion above, it is readily apparent that the antenna of the present invention is capable of having the elevation at which it scans for or transmits signals, the look angle of the effective antenna boresight, adjusted by selecting different feed antenna radiators or elements on the antenna extension. This has the same effect as physically raising and lowering an antenna to adjust the look angle to better track satellite 2014. An example of such elevation scanning is disclosed in U.S. patent application Ser. No. 08/922,719 filed Sep. 3, 1997 entitled "Steerable Antenna System," which is incorporated herein by reference.

The antenna system of the present invention could also be mounted on a movable platform that allows some course adjustment in elevation, before using a finer adjustment provided by changing radiators. Alternatively, a fixed support structure is used that is offset at preselected angles for specific scanning applications.

As truck 2002 travels, antenna system 1900 must be capable of maintaining contact with hub 2008 via satellite 2014. To do so, antenna system 1900 is connected to a controller to enable the antenna, or antenna extension, to rotate and to alter the scanning elevation to automatically acquire or track the path of satellite 2014. This involves not only changing azimuth position but also the look angle of the antenna to efficiently receive signals from the satellite.

The antenna is generally swept through a series of 360° arcs by a controller (not shown) until a signal is detected from satellite 2014, in the receiver's frequency range, above a predetermined threshold. This is accomplished, as discussed above, by rotating the dielectric lens including extension portion 900 and/or lens portion 800. At this juncture, one or more tracking and signal processes or processing methods are used to determine the direction of the highest signal strength and the antenna tracks that direction relative to the position or movement of receiver or truck 2002.

Similarly, as truck 2002 moves toward or away from the orbital plane of satellite 2014 overhead, the inclination angle for satellite 2014 with respect to antenna system 1900 changes. The controller knows the orbital plane of the satellite and the location of truck 2002 relative to the satellite's orbit, so that it can determine when the elevation of antenna system 1900 should be adjusted to more efficiently track satellite 2014. For example, the geosynchronous orbit or orbital track for a satellite used for communicating with a truck or other object may station the satellite at a longitude across the center of the United States. Thus, in this example, when the truck is near the southern United States border or Mexico, the satellite is stationed high overhead so that the antenna should be at a high elevation. However, as the truck moves considerably north of this longitude, the inclination angle for the satellite is lower on the horizon relative to the antenna. Thus, the antenna should be adjusted to a lower elevation.

The controller of the antenna system of present invention is programmed so that when truck 2002 reaches a certain position, the controller will stop the searching process for adjusting the azimuth of antenna system 1900 and will instead adjust the elevation of the antenna. After the elevational position of antenna system 1900 has been adjusted, the controller causes antenna system 1900 to resume a searching process to adjust the azimuthal position of antenna system 1900 to re-acquire satellite 2014.

In the preferred embodiment, the controller is configured to have at least one neutral band approximately 10° in latitude, in which the elevation of antenna system 1900 remains unchanged. This is to prevent the controller from constantly adjusting the elevation of the antenna if the truck happens to be traveling through an area near the point at which a change in elevation becomes desirable. For example, if a truck is traveling south and crosses into the northern most portion of the neutral band, the controller will not shift the look angle until the truck passes the southernmost portion of this band.

Similarly, if the truck crosses back into the neutral band after the look angle has been changed, the controller will not instantly change the look angle back to its former position. Instead, the controller will wait to adjust the look angle until the truck passes all the way through to the other end of the neutral band. This neutral area avoids unnecessary wear and tear on the assembly and prevents constant shifting between look angles at or near the changeover point. Thus, in the preferred embodiment, the antenna will shift elevation, alternative antenna elements, only after it passes completely through the neutral band to the north or south of the changeover point. It would be apparent to one skilled in the relevant art that a wider or narrow band of neutral area could be used to accommodate the particular use of the antenna.

The previous description of the preferred embodiments is provided to enable any person skilled in the art to make or use the present invention. While the invention has been particularly shown and described with reference to preferred embodiments thereof, it will be understood by those skilled in the art that various changes in form and details may be made therein without departing from the spirit and scope of the invention. For example the lens portion may not be exactly hemispherical but may be shaped or have other shapes for specific applications as may be used to direct radiation in a particular type of desired pattern.

What I claim as my invention is:

1. A dielectric lens for an antenna comprising:

a hemispherical lens portion comprised of a dielectric material formed in a generally hemispherical shape; and an extension portion comprising a dielectric substrate having at least one surface, said surface providing a location on which to position one or more antennas such that said one or more antennas are within a predetermined range of extension lengths from a center of a sphere described by the hemispherical lens wherein said extension portion comprises a plurality of dielectric substrates.

2. The dielectric lens of claim 1, wherein said extension portion includes an angled portion, to allow a feed antenna to be positioned off axis from a central axis for said hemispherical lens.

3. The dielectric lens of claim 2, wherein said angled portion provides a roughly constant radiation path.

4. The dielectric lens of claim 2, wherein said angled portion includes at least one planar surface.

5. The dielectric lens of claim 2, wherein said extension portion is conically shaped.

6. The dielectric lens of claim 2, wherein said extension portion is spherically shaped.

7. The dielectric lens of claim 2, wherein said extension portion is rotatable.

8. The dielectric lens of claim 7, wherein said extension portion is rotatable with respect to said hemispherical lens portion.

9. The dielectric lens of claim 1, wherein said extension portion comprises a plurality of planar silicon wafers combined in a layered fashion to achieve a desired extension length.

10. The dielectric lens of claim 1, wherein said extension portion has at least two or more feed antennas mounted on said surface.

11. The dielectric lens of claim 10, wherein said at least two or more feed antennas comprises a two dimensional array of antenna feeds mounted on said surface.

12. The dielectric lens of claim 1, wherein said extension portion has at least two or more feed antennas mounted in close proximity with said extension portion.

13. The dielectric lens of claim 1 further comprising an angled extension for the dielectric lens comprising an n-sided pyramids, where n is greater than 2.

14. The dielectric lens of claim 13 further comprising antenna feeds mounted on at least one of the surfaces formed by the pyramidal extension.

15. The dielectric lens of claim 14 comprising an array of antennas mounted on each surface of at least two surfaces of the pyramid, allowing a directionality of the antenna to be chosen by selection of the antennas in the arrays.

16. The dielectric lens of claim 1, comprising an array of antennas mounted on said at least one surface of said extension portion, allowing a directionality of the antenna to be chosen by selection of the antennas in the arrays.

17. The dielectric lens of claim 1, further comprising a rotatable dielectric element having at least one surface for mounting antenna feeds and at least two or more feed antennas mounted on said surface.

18. The dielectric lens of claim 7, wherein said rotatable dielectric element comprises a conical shape having with a central axis with a wider planar portion positioned adjacent to said extension portion of said dielectric lens and with a narrower portion positioned away from said extension portion of said dielectric lens.

19. The dielectric lens of claim 18, wherein said rotatable dielectric element comprises an overall shape of a frustrated cone.

20. The dielectric lens of claim 18, wherein said rotatable dielectric element comprises a conical shape having a cross section that is not an equilateral triangle.

21. The dielectric lens of claim 18, wherein said rotatable dielectric element comprises a planar segment along a chord substantially perpendicular to said axis for supporting feed elements.

22. The dielectric lens of claim 18, wherein said feed antenna is chosen from the group of a double-slot antenna, a spiral antenna, a complemetary spiral antenna, and a bow tie.

23. The dielectric lens of claim 1, wherein said hemispherical dielectric lens comprises:

a first dielectric hemispherical lens; and a second dielectric hemispherical lens coupled with the first dielectric hemisphere lens to provide a constant extension length throughout a broad range of azimuth and elevation angles.

24. The vehicle communication system of claim 23 further comprising:

a shaft coupled to said extension portion; and a motor coupled to said shaft which can rotate the extension thereby changing the lens directivity as desired.

25. A vehicle communication system comprising:

a dielectric lens for an antenna, comprising:

a hemispherical lens comprised of a dielectric material formed in a generally hemispherical shape;

an extension portion formed from one or more dielectric substrates;

a routable dielectric element having at least one surface on which to position one ore more antenna feeds within a predetermined range of extension lengths from a center of a sphere described by the hemispherical lens; and a vehicle support means for securing the dielectric lens to a surface of a vehicle.

* * * * *